US006913349B2

(12) United States Patent
Hirota

(10) Patent No.: US 6,913,349 B2
(45) Date of Patent: Jul. 5, 2005

(54) INK-JET HEAD AND INK-JET PRINTER HAVING INK-JET HEAD

(75) Inventor: Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/367,848

(22) Filed: Feb. 19, 2003

(65) Prior Publication Data

US 2004/0041885 A1 Mar. 4, 2004

(30) Foreign Application Priority Data

Feb. 18, 2002 (JP) ..... 2002-040524

(51) Int. Cl.[7] ..... B41J 2/045
(52) U.S. Cl. ..... 347/72
(58) Field of Search ..... 347/68, 70–72

(56) References Cited

U.S. PATENT DOCUMENTS

| | | | | |
|---|---|---|---|---|
| 5,087,930 | A | 2/1992 | Roy et al. | |
| 5,402,159 | A | 3/1995 | Takahashi et al. | |
| 5,406,318 | A | 4/1995 | Moore et al. | |
| 5,548,894 | A | 8/1996 | Muto | |
| 6,109,736 | A | 8/2000 | Miyata et al. | |
| 6,325,488 | B1 | 12/2001 | Beerling et al. | |
| 6,431,691 | B1 * | 8/2002 | Tanikawa et al. | 347/70 |
| 6,550,897 | B2 | 4/2003 | Nakamura et al. | |
| 2002/0003560 | A1 | 1/2002 | Isono et al. | |
| 2003/0156157 | A1 | 8/2003 | Suzuki et al. | |
| 2003/0156166 | A1 | 8/2003 | Sakaida | |

FOREIGN PATENT DOCUMENTS

| | | |
|---|---|---|
| EP | 0 755 792 A2 | 1/1997 |
| EP | 0 800 920 A2 | 10/1997 |
| EP | 0 976 560 A2 | 2/2000 |
| JP | 61-079669 | 4/1986 |
| JP | A 7-67803 | 7/1995 |
| JP | B2 7-96301 | 10/1995 |
| JP | 2002-19102 | 1/2002 |
| WO | WO99/42292 | 8/1999 |

* cited by examiner

*Primary Examiner*—Stephen D. Meier
*Assistant Examiner*—An H. Do
(74) *Attorney, Agent, or Firm*—Oliff & Berridge, PLC

(57) ABSTRACT

An ink-jet head according to the invention includes a passage unit including a plurality of pressure chambers one end of each of which is connected to a nozzle and the other end of which is to be connected to an ink supply source, and actuator unit for changing the volume of each of the pressure chambers. The actuator unit includes a common electrode maintained at a constant potential, a plurality of individual electrodes arranged at positions corresponding to each pressure chamber, and a plurality of piezoelectric sheets which are sequentially laminated. The piezoelectric sheets most distant from the pressure chamber among the plurality of piezoelectric sheets is sandwiched between the common electrode and at least one of the individual electrodes. Further, each of the individual electrodes arranged on a face of the piezoelectric sheet most distant from the pressure chamber facing the direction opposite to the pressure chamber is electrically bonded to a feeding terminal provided on an electricity feeding member at each of a plurality of electric contacts on the individual electrode.

18 Claims, 13 Drawing Sheets

INK-JET HEAD AND INK-JET PRINTER HAVING INK-JET HEAD

BACKGROUND OF THE INVENTION

1. Field of Invention

The present invention relates to an ink-jet head for printing by ejecting ink onto a print medium, and to an ink-jet printer having the ink-jet head.

2. Description of Related Art

In an ink-jet printer, an ink-jet head distributes ink, which is supplied from an ink tank, to pressure chambers. The ink-jet head selectively applies pressure to each pressure chamber to eject ink through a nozzle. As a means for selectively applying pressure to the pressure chambers, an actuator unit may be used in which ceramic piezoelectric sheets are laminated.

As an example, an ink-jet head, as described above, has one actuator unit in which continuous flat piezoelectric sheets extending over a plurality of pressure chambers are laminated. At least one of the piezoelectric sheets is sandwiched by a common electrode, common to many pressure chambers and being kept at the ground potential, and many individual electrodes, i.e., driving electrodes, disposed at positions corresponding to the respective pressure chambers. The part of the piezoelectric sheet being sandwiched by the individual and common electrodes is polarized in its thickness and is expanded or contracted in its thickness direction as an active layer, by the so-called longitudinal piezoelectric effect, when a individual electrode on one face of the sheet is set at a different potential from that of the common electrode on the other face. The volume of the corresponding pressure chamber thereby changes, so ink can be ejected toward a print medium through a nozzle communicating with the pressure chamber.

In the ink-jet head, the individual electrode and an electricity feeding member for supplying a drive signal must be connected directly, or indirectly via a separate member. It is very important to promote the reliability of such connection, to prevent the failure of the ink-jet head and the ink-jet printer including the ink-jet head.

SUMMARY OF THE INVENTION

A principal object of the present invention is to provide an ink-jet head capable of promoting the reliability of electric connection between an individual electrode, in an actuator unit, and an electricity feeding member, and an ink-jet printer including the same.

According to a first aspect of the invention, there are provided an ink-jet head comprising: a passage unit including a plurality of pressure chambers each having one end connected with a nozzle and the other end connected with an ink supply source, the plurality of pressure chambers being arranged along a plane and neighboring each other; an actuator unit fixed to a surface of the passage unit for changing the volume of each of the pressure chambers; and an electricity feeding member having a feeding terminal for supplying a drive signal to the actuator unit. The actuator unit comprises: a common electrode maintained at a constant potential; a plurality of individual electrodes arranged at positions corresponding to each pressure chamber; and a plurality of piezoelectric sheets which are sequentially laminated, the piezoelectric sheet most distant from the pressure chamber being sandwiched between the common electrode and at least one of the individual electrodes. Each of the individual electrodes are arranged on a face of the piezoelectric sheet most distant from the pressure chamber, facing the direction opposite to the pressure chamber, which is electrically bonded to the feeding terminal at each of a plurality of electric contacts on the individual electrode. The present invention also provides an ink-jet printer having the ink-jet head.

According to a second aspect of the invention, there is provided an ink-jet head comprising: a passage unit including a plurality of pressure chambers each having one end connected with a nozzle and the other end connected with an ink supply source, the plurality of pressure chambers being arranged along a plane and neighboring each other; an actuator unit fixed to a surface of the passage unit for changing the volume of each of the pressure chambers; and an electricity feeding member having a feeding terminal for supplying a drive signal to the actuator unit. The actuator unit comprises: a common electrode maintained at a constant potential; a plurality of individual electrodes arranged at positions corresponding to each pressure chamber; a plurality of piezoelectric sheets which are sequentially laminated, at least one of the piezoelectric sheets other than the piezoelectric sheet most distant from the pressure chamber being sandwiched between the common electrode and at least one of the individual electrodes; and a plurality of surface electrodes arranged on a face of the piezoelectric sheet most distant from the pressure chamber facing the direction opposite to the pressure chamber at positions corresponding to the individual electrodes. Each of the surface electrodes are connected to a corresponding one of the individual electrode via a conductive material provided at the inside of a through hole penetrating a single or a plurality of the piezoelectric sheets and electrically bonded to the feeding terminal at each of a plurality of electric contacts on the surface electrode.

By connecting the individual electrode and the feeding terminal provided on the electricity feeding member directly or indirectly via the surface electrode, and by electrically bonding the individual electrode or the surface electrode and the electricity feeding member at the plurality of electric contacts, even when the individual electrode or the surface electrode and the electricity feeding member have not been electrically bonded at one or more contacts in the plurality of electric contacts, or the electric bonding is released at one or more contacts in the plurality of electric contacts, electric connection between the two members is ensured. Thus, reliability of electric connection between the individual electrode and the electricity feeding member is promoted and the ink-jet head and the ink-jet printer having the ink-jet head are unlikely to fail.

Further, by arranging the individual electrode or the surface electrode on the face of the piezoelectric sheet most distant from the pressure chamber, facing the direction opposite to the pressure chamber, at the position corresponding to each of the pressure chambers, and by electrically bonding the individual electrode or the surface electrode and the feeding terminal provided on the electricity feeding member, it is not necessary to separately form a conductive member for electrically connecting the individual electrode or the surface electrode and the electricity feeding member along the piezoelectric sheet up to an end portion thereof. The separate conductive member is formed to avoid the individual electrode or the surface electrode arranged on the piezoelectric sheet of a topmost layer. Therefore, in order to ensure sufficient electric insulating performance, it is necessary to sufficiently ensure a space between the individual electrodes or the surface electrodes. As a result, the number of the pressure chambers in a predetermined area is reduced. In addition, the above-described separate conductive member may obstruct deformation of the piezoelectric sheet in the lamination direction.

According to the invention, the individual electrode or the surface electrode and the electricity feeding member can be electrically connected without providing the separate conductive member as described above. Thus, the number of the pressure chambers in a predetermined area can be increased. Further, a displacement of the piezoelectric sheet in the lamination direction can be increased.

According to a third aspect of the invention, there are provided an ink-jet head comprising: a passage unit including a plurality of pressure chambers each having one end connected with a nozzle and the other end connected with an ink supply source, the plurality of pressure chambers being arranged along a plane and neighboring each other; an actuator unit fixed to a surface of the passage unit for changing the volume of each of the pressure chambers; and an electricity feeding member having a feeding terminal for supplying a drive signal to the actuator unit. The actuator unit comprises: a common electrode maintained at a constant potential; a plurality of individual electrodes arranged at positions corresponding to each pressure chamber; a plurality of piezoelectric sheets which are sequentially laminated. The piezoelectric sheet most distant from the pressure chamber is sandwiched between the common electrode and at least one of the individual electrodes and each of the individual electrodes is arranged on a face of the piezoelectric sheet most distant from the pressure chamber, facing the direction opposite to the pressure chamber, being electrically bonded to the feeding terminal. A plurality of peripheral electrodes are arranged on the face of the piezoelectric sheet most distant from the pressure chamber, facing the direction opposite to the pressure chamber, at the periphery of a region in which the plurality of the individual electrodes are arranged, at least one of the peripheral electrodes being electrically connected to the common electrode and electrically bonded to the feeding terminal. The present invention also provides an ink-jet printer having the previously described ink-jet head.

According to a fourth aspect of the invention, there is provided an ink-jet head comprising: a passage unit including a plurality of pressure chambers each having one end connected with a nozzle and the other end connected with an ink supply source, the plurality of pressure chambers being arranged along a plane and neighboring each other; an actuator unit fixed to a surface of the passage unit for changing the volume of each of the pressure chambers; and an electricity feeding member having a feeding terminal for supplying a drive signal to the actuator unit. The actuator unit comprises: a common electrode maintained at a constant potential; a plurality of individual electrodes arranged at positions corresponding to each pressure chamber; a plurality of piezoelectric sheets which are sequentially laminated. At least one of the piezoelectric sheets other than the piezoelectric sheet most distant from the pressure chamber is sandwiched between the common electrode and at least one of the individual electrodes. A plurality of surface electrodes are arranged on a face of the piezoelectric sheet most distant from the pressure chamber, facing the direction opposite to the pressure chamber, at positions corresponding to the individual electrodes, each of the surface electrodes being connected to a corresponding one of the individual electrode via a conductive material provided at the inside of a through hole penetrating a single or a plurality of the piezoelectric sheets and electrically bonded to the feeding terminal. Finally, a plurality of peripheral electrodes are arranged on the face of the piezoelectric sheet most distant from the pressure chamber facing the direction opposite to the pressure chamber at the periphery of a region in which the plurality of the surface electrodes are arranged, at least one of the peripheral electrodes being electrically connected to the common electrode and electrically bonded to the feeding terminal.

By electrically bonding at least one of the plurality of peripheral electrodes to the feeding terminal of the electricity feeding member, when the electricity feeding member is exposed to an external force for peeling off the electricity feeding member, only after releasing the electric bonding between the electricity feeding member and the peripheral electrode, the electric bonding of the individual electrode or the surface electrode and the feeding terminal is released. Therefore, unless comparatively large force is exerted, the electric bonding between the individual electrode or the surface electrode and the feeding terminal is not released. As a result, reliability of the electric connection is promoted, and the ink-jet head and the ink-jet printer having the ink-jet head are resistant to failure.

Further, by electrically connecting at least one of the peripheral electrodes to the common electrode and electrically bonding the peripheral electrode to the feeding terminal, the common electrode can be maintained at the constant potential without using a separate member besides the electricity feeding member. That is, the electricity feeding member can serve to supply the drive signal to the individual electrode and to maintain the common electrode at the constant potential and therefore, the structure of the ink-jet head can be simplified.

Further, by arranging the individual electrode or the surface electrode on the face of the piezoelectric sheet most distant from the pressure chamber, facing the direction opposite to the pressure chamber at the position corresponding to each of the pressure chambers, and by electrically bonding the individual electrode or the surface electrode and the feeding terminal provided on the electricity feeding member, it is not necessary to separately form a conductive member for electrically connecting the individual electrode or the surface electrode and the electricity feeding member on the piezoelectric sheet. Therefore, the number of the pressure chambers in a predetermined area can be increased and a displacement of the piezoelectric sheet in the lamination direction can be increased.

According to a fifth aspect of the invention, there is provided an ink-jet head comprising: a passage unit including a plurality of pressure chambers each having one end connected with a nozzle and the other end connected with an ink supply source, the plurality of pressure chambers being arranged along a plane and neighboring each other; an actuator unit fixed to a surface of the passage unit for changing the volume of each of the pressure chambers; and an electricity feeding member having a feeding terminal for supplying a drive signal to the actuator unit. The actuator unit comprises: a common electrode maintained at a constant potential; a plurality of individual electrodes arranged at positions corresponding to each pressure chamber; and a plurality of piezoelectric sheets which are sequentially laminated, the piezoelectric sheet most distant from the pressure chamber being sandwiched between the common electrode and at least one of the individual electrodes. Each of the individual electrodes arranged on a face of the piezoelectric sheet most distant from the pressure chamber face the direction opposite to the pressure chamber that is electrically bonded to the feeding terminal at each of a plurality of electric contacts on the individual electrode. The individual electrode comprises: a first electrode region having a planar shape similar to a planar shape of the pressure chamber; a second electrode region connected to one end of the first electrode region and having one of the electric contacts; and a third electrode region connected to the other end of the first electrode region, opposite from the second electrode region, and having one of the electric contacts. The interconnecting part of the first electrode region and the second electrode region is provided with a length shorter than the lengths of the first electrode region and the second electrode region with respect to a direction substantially orthogonal to an imaginary line connecting the second electrode region and the third electrode region. The interconnecting part of the first electrode region and the third electrode region is provided with a length shorter than the lengths of the first electrode region and the third electrode region with respect to the direction substantially orthogonal to an imaginary line connecting the second electrode region and the third electrode region.

As a result, in addition to promoting reliability of the electric connection between the individual electrode and the electricity feeding member of the actuator unit as in the above-described invention, the range of the active layer corresponding to the interconnecting part the first electrode region and the second electrode region and the interconnecting part the first electrode region and the third electrode region is reduced, thereby increasing the distance between active layers corresponding to the adjacent pressure chambers, so as to restrain "crosstalk" from occurring between the adjacent pressure chambers.

BRIEF DESCRIPTION OF THE DRAWINGS

Various exemplary embodiments of the invention will be described in detail with reference to the following figures, wherein.

DETAILED DESCRIPTION OF PREFERRED EMBODIMENTS

Figure 1:
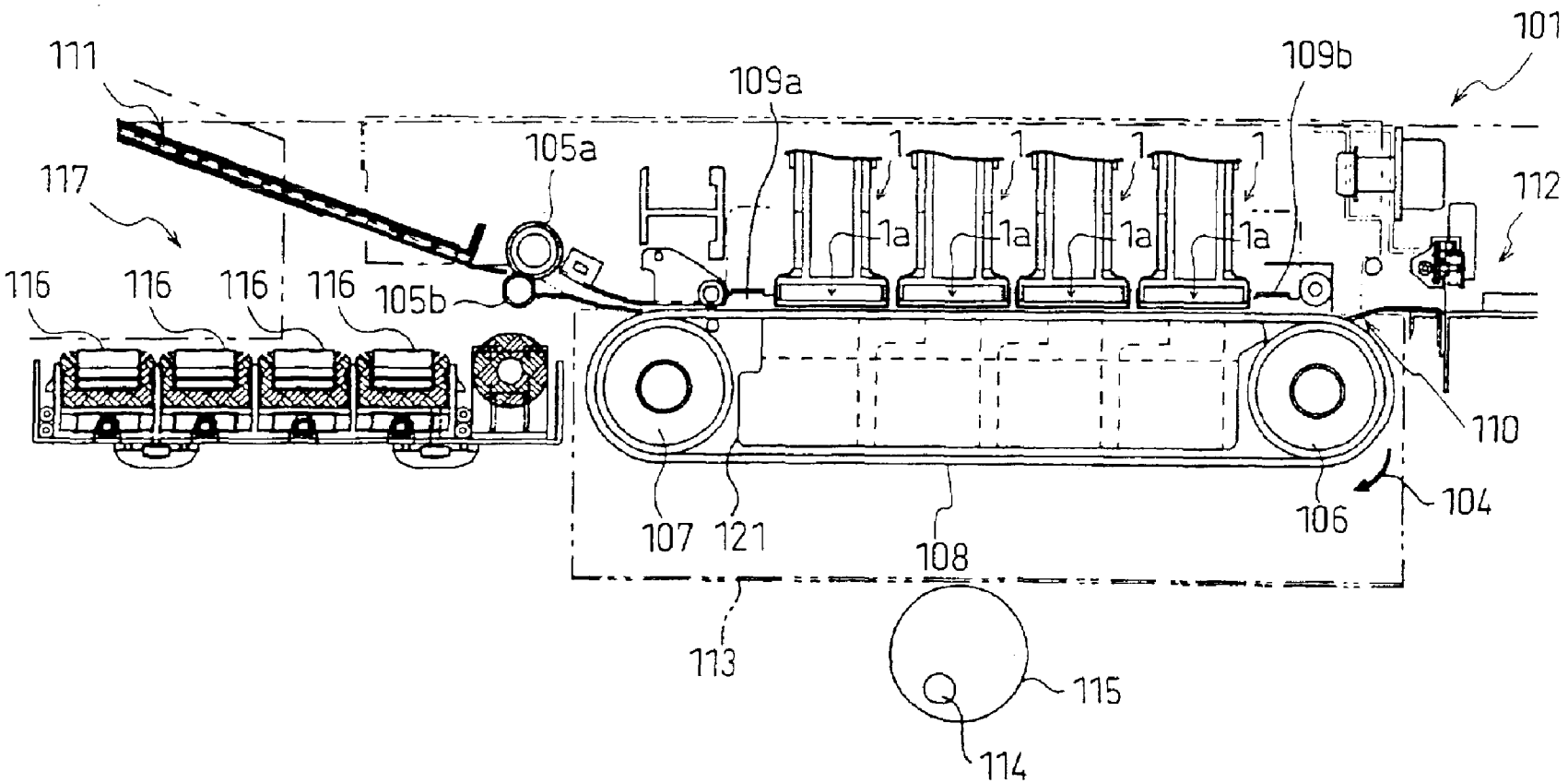
FIG. 1 is an general view of an ink-jet printer including ink-jet heads according to a first embodiment of the invention.

FIG. 1 is a general view of an ink-jet printer including ink-jet heads according to a first embodiment of the invention. The ink-jet printer 101 as illustrated in FIG. 1 is a color ink-jet printer having four ink-jet heads 1. In the printer 101, a paper feed unit 111 and a paper discharge unit 112 are disposed in left and right portions of FIG. 1, respectively.

In the printer 101, a paper transfer path is provided extending from the paper feed unit 111 to the paper discharge unit 112. A pair of feed rollers 105*a* and 105*b* are disposed immediately downstream (rightward) of the paper feed unit 111 for pinching and advancing an image record medium for example a sheet of paper, card stock, photo paper, a transparency, or the like. The image recording medium is transferred by the pair of feed rollers 105*a* and 105*b*, from the left to the right in FIG. 1. In the middle of the paper transfer path, two belt rollers 106 and 107 and an endless transfer belt 108 are disposed. The transfer belt 108 is wound on the belt rollers 106 and 107 and extended between them. The outer face, i.e., the transfer face, of the transfer belt 108 has been treated with silicone. Thus, an image recording medium fed through the pair of feed rollers 105*a* 105*b* can be held on the transfer face of the transfer belt 108 by the adhesion of the silicone treated face. In this state, the image recording medium is transferred downstream by driving belt roller 106 to rotate clockwise in FIG. 1 (the direction indicated by an arrow 104).

Pressing members 109*a* and 109*b* are disposed at positions for feeding an image recording medium onto the belt roller 106 and extracting the image recording medium from the belt roller 106, respectively. Either of the pressing members 109*a* and 109*b* is for pressing the image recording medium onto the transfer face of the transfer belt 108 so as to prevent the paper from separating from the transfer face of the transfer belt 108. Thus, the image recording medium securely adheres to the transfer face.

A peeling device 110 is provided immediately downstream of the transfer belt 108 along the paper transfer path. The peeling device 110 peels off the image recording medium, which has adhered to the transfer face of the transfer belt 108, from the transfer face to transport the paper toward the rightward paper discharge unit 112.

Each of the four ink-jet heads 1 has, at its lower end, a head main body 1*a*. Each head main body 1 a has a rectangular section. The head main bodies 1*a* are arranged close to each other with the longitudinal axis of each head main body 1*a* being perpendicular to the paper transfer direction (perpendicular to FIG. 1). That is, printer 101 is a line type printer. The bottom of each of the four head main bodies 1*a* faces the paper transfer path. In the bottom of each head main body 1*a*, a number of nozzles are provided each having a small-diameter ink ejection port. The four head main bodies 1*a* eject ink of magenta, yellow, cyan, and black, respectively. However, various other embodiments of the invention are not limited by the above described colors or order.

The head main bodies 1*a* are disposed such that a narrow clearance must be formed between the lower face of each head main body 1*a* and the transfer face of the transfer belt 108. The paper transfer path is formed within the narrow clearance. In this embodiment, while an image recording medium, which is being transferred by the transfer belt 108, passes immediately below the four head main bodies 1*a* in order, the inks are ejected through the corresponding nozzles toward the upper face, i.e., the print face, of the image recording medium to form a desired image on the image recording medium.

The ink-jet printer 101 is provided with a maintenance unit 117 for automatically carrying out maintenance of the ink-jet heads 1. The maintenance unit 117 includes four caps 116 for covering the lower faces of the four head main bodies 1*a*, and a purge system. That is not illustrated.

The maintenance unit 117 is at a position immediately below the paper feed unit 117 (withdrawal position) while the ink-jet printer 101 operates to print. When a predetermined condition is satisfied after finishing the printing operation (for example, when a state in which no printing operation is performed continues for a predetermined time period or when the printer 101 is powered off), the maintenance unit 117 moves to a position immediately below the four head main bodies 1*a* (cap position), where the maintenance unit 117 covers the lower faces of the head main bodies 1*a* with the respective caps 116 to prevent the ink in the nozzles of the head main bodies 1*a* from being dried.

The belt rollers 106 and 107 and the transfer belt 108 are supported by a chassis 113. The chassis 113 is set on a cylindrical member 115 disposed under the chassis 113. The cylindrical member 115 is rotatable around a shaft 114 provided at a position deviating from the center of the cylindrical member 115. Thus, by rotating the shaft 114, the level of the uppermost portion of the cylindrical member 115 can be changed to move the chassis 113 up or down accordingly. When the maintenance unit 117 is moved from the withdrawal position to the cap position, the cylindrical member 115 will have been rotated at a predetermined angle in advance so as to move the transfer belt 108 and the belt rollers 106 and 107 down by a distance from the position illustrated in FIG. 1. Thereby creating a space for the movement of the maintenance unit 117.

In the region surrounded by the transfer belt 108, a nearly rectangular guide 121 (having its width substantially equal to that of the transfer belt 108) is disposed at a position opposite to the ink-jet heads 1. The guide 121 is in contact with the lower face of the upper part of the transfer belt 108 to support the upper part of the transfer belt 108 from the inside.

Figure 2:
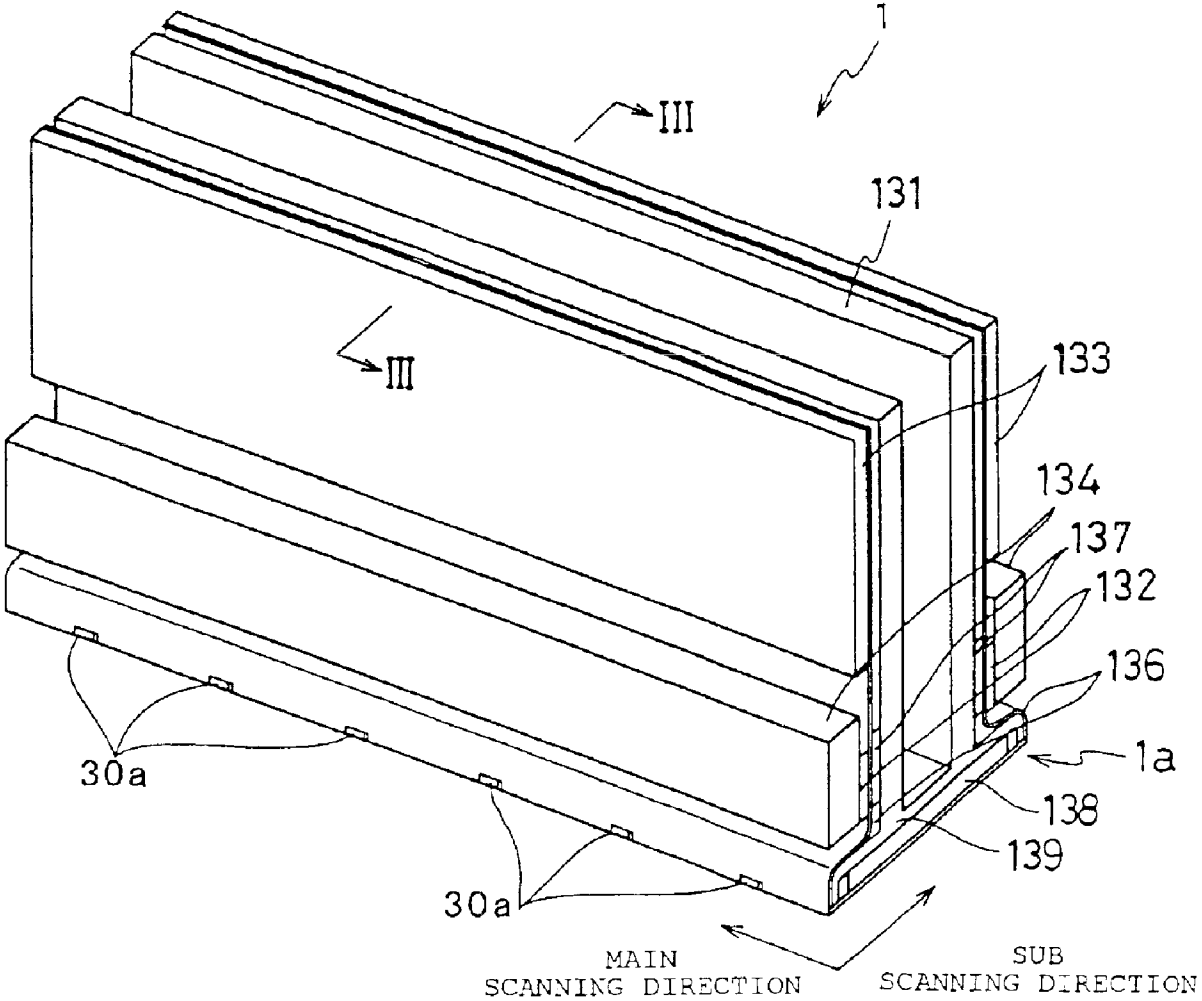
FIG. 2 is a perspective view of the ink-jet head according to the first embodiment of the invention.
Figure 3:
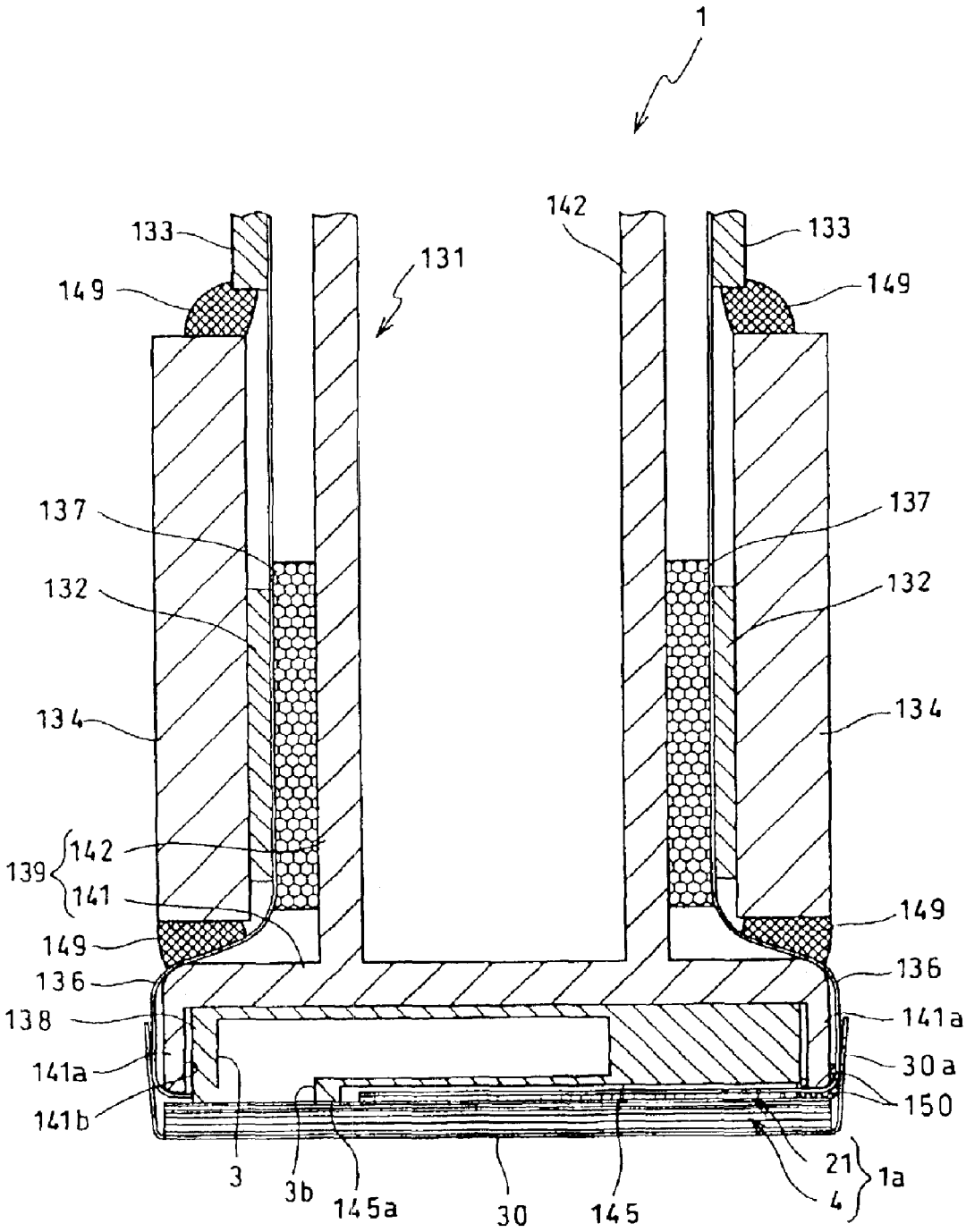
FIG. 3 is a sectional view taken along a line III—III in FIG. 2.

Referring to FIGS. 2 and 3, the construction of each ink-jet head 1 according to this embodiment will be described in more detail. FIG. 3 is a sectional view taken along line III—III in FIG. 2. The ink-jet head 1 according to this embodiment includes a head main body 1*a* having a rectangular shape in a plan view with its longest side extending in the main scanning direction, and a base portion 131 for supporting the head main body 1*a*. The base portion 131 supporting the head main body 1*a* further supports driver ICs 132 for supplying driving signals to individual electrodes 35*a* and 35*b* (see FIG. 9), and substrates 133.

Referring to FIG. 2, the base portion 131 is made up of a base block 138 partially bonded to the upper face of the head main body 1*a* to support the head main body 1*a*, and a holder 139 bonded to the upper face of the base block 138 to support the base block 138. The base block 138 is a nearly rectangular member having substantially the same length as the head main body 1*a*. The base block 138 made of metal material, such as stainless steel, is a light structure for reinforcing the holder 139. The holder 139 comprises a holder main body 141 disposed near the head main body 1*a*, and a pair of holder support portions 142 each extending on the opposite side of the holder main body 141 from the head main body 1*a*. Each holder support portion 142 is as a flat member. These holder support portions 142 extend along the longitudinal direction of the holder main body 141 and are disposed substantially parallel to each other at a predetermined interval.

Skirt portions 141*a* in a pair, protruding downward, are provided in both end portions of the holder main body 141*a* when viewed in a plane perpendicular to the main scanning direction. Each skirt portion 141*a* is formed through the length of the holder main body 141. As a result, in the lower portion of the holder main body 141, a nearly rectangular groove 141*b* is defined by the pair of skirt portions 141*a*. The base block 138 is received in the groove 141*b*. The upper surface of the base block 138 is bonded to the bottom of the groove 141*b* of the holder main body 141 with an adhesive. The thickness of the base block 138 is somewhat larger than the depth of the groove 141*b* of the holder main body 141. As a result, the lower end of the base block 138 protrudes downward beyond the skirt portions 141*a*.

Within the base block 138, as a passage for ink to be supplied to the head main body 1*a*, an ink reservoir 3 is formed as a nearly rectangular space (hollow region) extending along the longitudinal direction of the base block 138. In the lower face 145 of the base block 138, openings 3*b* (see FIG. 4) are formed, each communicating with the ink reservoir 3. The ink reservoir 3 is connected through a non-illustrated supply tube with a non-illustrated main ink tank (ink supply source) within the printer main body. Thus, the ink reservoir 3 is suitably supplied with ink from the main ink tank.

In the lower face 145 of the base block 138, the vicinity portion 145*a* of each opening 3*b* protrudes downward from the surrounding portion. The base block 138 is in contact with a passage unit 4 (see FIG. 3) of the head main body 1*a* only at the vicinity portion 145*a* of each opening 3*b* of the lower face 145. Thus, the region of the lower face 145 of the base block 138 other than the vicinity portion 145*a* of each opening 3*b* is distant from the head main body 1*a*. Actuator units 21 are disposed within the distance.

A driver IC 132 is fixed to the outside face of each holder support portion 142 of the holder 139 with an elastic member 137, such as a sponge being interposed between them. A heat sink 134 is disposed in close contact with the outside face of the driver IC 132. The heat sink 134 is made of a nearly rectangular member for efficiently radiating heat generated in the driver IC 132. As a power supply a flexible printed circuit (FPC) 136 is connected to the driver IC 132. The FPC 136 connected to the driver IC 132 is bonded to and electrically connected with the corresponding substrate 133 and the head main body 1*a* by soldering. The substrate 133 is disposed outside the FPC 136 above the driver IC 132 and the heat sink 134. The upper face of the heat sink 134 is bonded to the substrate 133 with a seal member 149. Also, the lower face of the heat sink 134 is bonded to the FPC 136 with a seal member 149.

Between the lower face of each skirt portion 141*a* of the holder main body 141 and the upper face of the passage unit 4, a seal member 150 is disposed to sandwich the FPC 136. The FPC 136 is fixed by the seal member 150 to the passage unit 4 and the holder main body 141. Therefore, even if the head main body 1*a* is elongated, the head main body 1*a* can be prevented from being bent, the interconnecting portion between each actuator unit and the FPC 136 can be prevented from receiving stress, and the FPC 136 can be held securely.

Referring to FIG. 2, in the vicinity of each lower corner of the ink-jet head 1 along the main scanning direction, six protruding portions 30*a* are disposed at regular intervals along the corresponding side wall of the ink-jet head 1. These protruding portions 30*a* are provided at both ends in of a nozzle plate 30 in the lowermost layer of the head main body 1*a* as viewed in a plane parallel to the main scanning direction (see FIGS. 7A and 7B). The nozzle plate 30 is bent by about 90 degrees along the boundary line between each protruding portion 30*a* and the other portion. The protruding portions 30*a* are provided at positions corresponding to the vicinity of both ends of various sized image recording mediums to be used for printing. Each bent portion of the nozzle plate 30 has a shape, not right-angled, but rounded. This makes it less likely to bring about clogging of an image recording medium, i.e., jamming, which may occur because the leading edge of the image recording medium, which has been transferred to approach the head 1, is stopped by the side face of the head 1.

Figure 4:
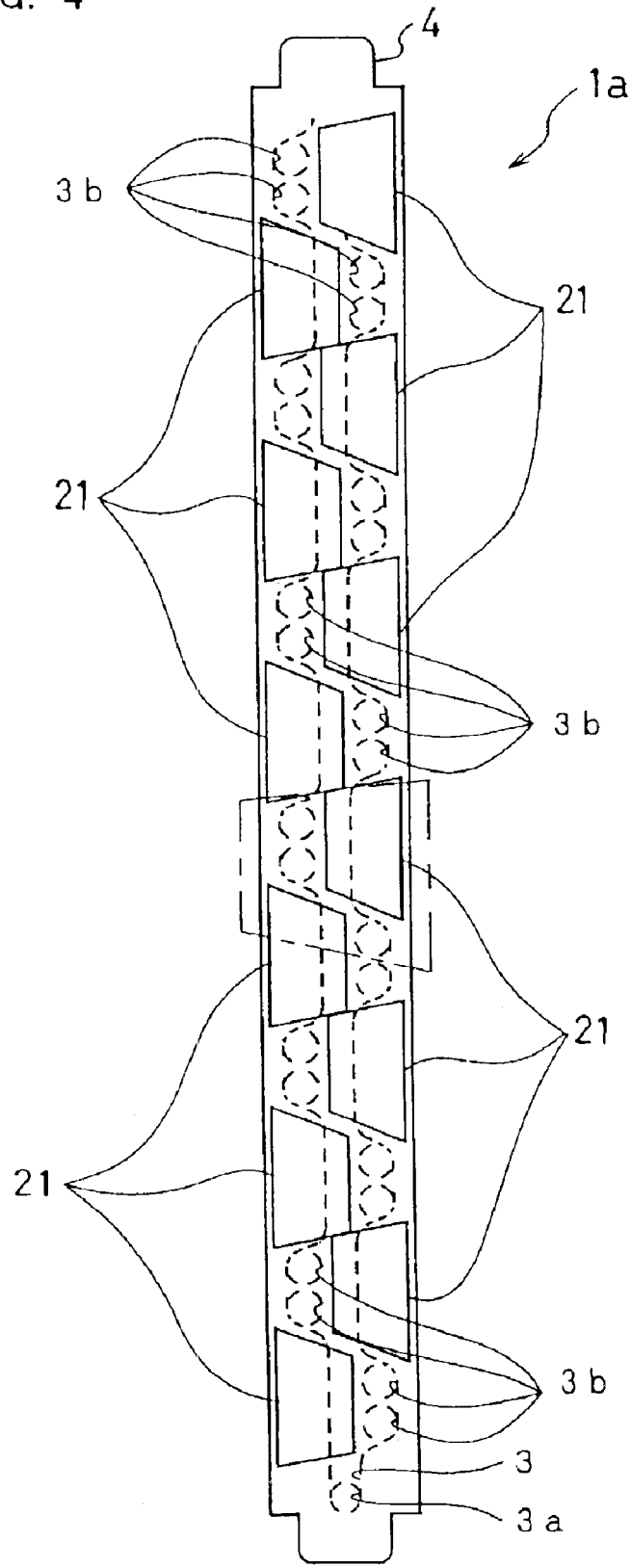
FIG. 4 is a plane view of a head main body included in the ink-jet head illustrated in FIG. 2.

FIG. 4 is a schematic plan view of the head main body 1*a*. In FIG. 4, an ink reservoir 3 formed in the base block 138 is illustrated with a broken line. Referring to FIG. 4, the head main body 1*a* has a rectangular shape in the plan view with the longer side extending in one direction (main scanning direction). The head main body 1*a* includes a passage unit 4 in which a large number of pressure chambers 10 and a large number of ink ejection ports 8 at the front ends of nozzles (as for both, see FIGS. 5, 6, and 7), as described later. Trapezoidal actuator units 21 arranged in two lines in a zigzag manner are bonded onto the upper face of the passage unit 4. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4.

The lower face of the passage unit 4 corresponding to the bonded region of each actuator unit 4 is made into an ink ejection region. In the surface of each ink ejection region, a large number of ink ejection ports 8 are arranged in a matrix, as described later. In the base block 138 disposed above the passage unit 4, an ink reservoir 3 is formed along the longitudinal direction of the base block 138. The ink reservoir 3 communicates with an ink tank (not illustrated) through an opening 3*a* provided at one end of the ink reservoir 3, so that the ink reservoir 3 is always filled with ink. In the ink reservoir 3, pairs of openings 3*b* are provided in regions where no actuator unit 21 is present, so as to be arranged in a zigzag manner along the longitudinal direction of the ink reservoir 3.

Figure 5:
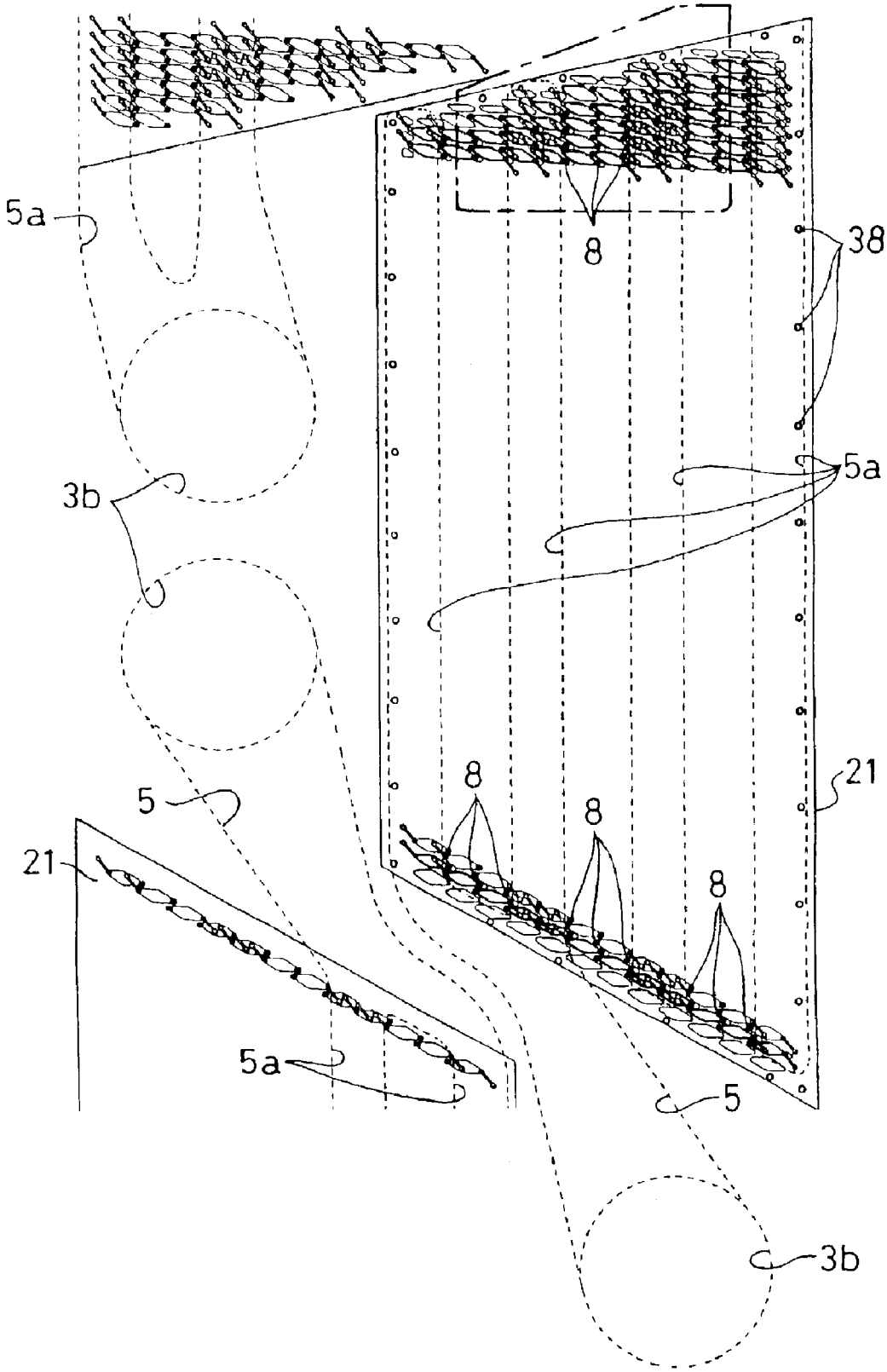
FIG. 5 is an enlarged view of the region enclosed with an alternate long and short dash line illustrated in FIG. 4.

FIG. 5 is an enlarged view of the region enclosed with an alternate long and short dash line in FIG. 4. Referring to FIGS. 4 and 5, the ink reservoir 3 communicates through each opening 3*b* with a manifold channel 5 disposed under the opening 3*b*. Each opening 3*b* is provided with a filter (not illustrated) for catching dust and dirt contained in ink. The front end portion of each manifold channel 5 branches into two sub-manifold channels 5*a*. Below a single one of the actuator units 21, two sub-manifold channels 5*a* extend from each of the two openings 3*b* on both sides of the actuator unit 21 in the longitudinal direction of the ink-jet head 1. That is, below the single actuator unit 21, four sub-manifold channels 5*a* in total extend along the longitudinal direction of the ink-jet head 1. Each sub-manifold channel 5*a* is filled up with ink supplied from the ink reservoir 3.

Figure 6:
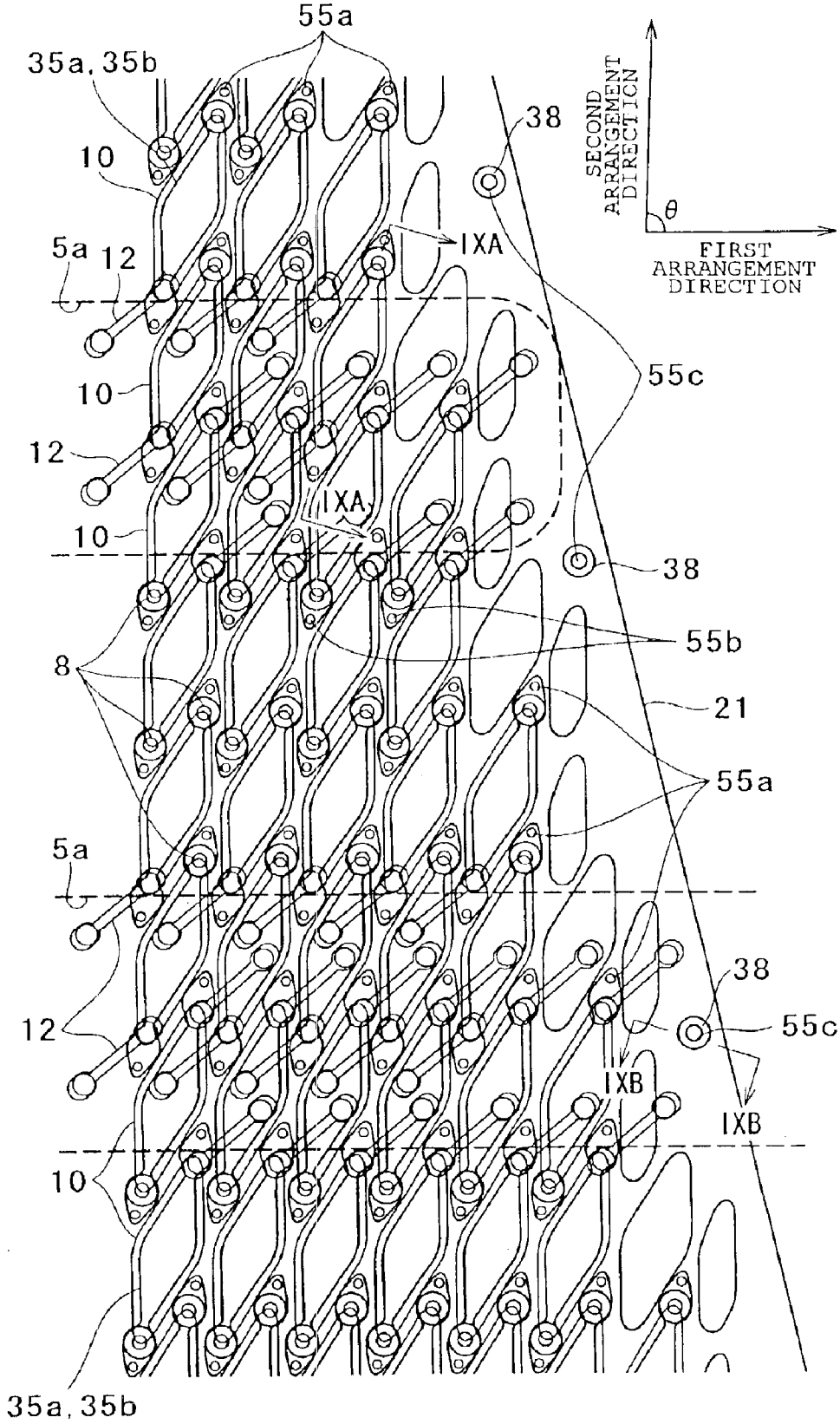
FIG. 6 is an enlarged view of the region enclosed with an alternate long and short dash line illustrated in FIG. 5.

FIG. 6 is an enlarged view of the region enclosed with an alternate long and short dash line in FIG. 5. Referring to FIGS. 5 and 6, on the upper face of each actuator unit 21, individual electrodes 35*a* each having a nearly rhombic shape in a plan view are regularly arranged in a matrix. In addition, individual electrodes 35*b*, having the same shape as the individual electrodes 35*a*, are disposed in the actuator unit 21 to vertically overlap the respective individual electrodes 35*a*. A large number of ink ejection ports 8 are regularly arranged in a matrix in the surface of the ink ejection region corresponding to the actuator unit 21 of the passage unit 4. In the passage unit 4, pressure chambers (cavities) 10. each having a nearly rhombic shape in a plan view somewhat larger than that of the individual electrodes 35*a* and 35*b*, are regularly arranged in a matrix. Besides in the passage unit 4, apertures 12 are also regularly arranged in a matrix. These pressure chambers 10 and apertures 12 communicate with the corresponding ink ejection ports 8. The pressure chambers 10 are provided at positions corresponding to the respective individual electrodes 35*a* and 35*b*. In a plan view, the large part of the individual electrodes 35*a* and 35*b* are included in a region of the corresponding pressure chamber 10. In FIGS. 5 and 6, for making it easy to understand the drawings, the pressure chambers 10, the apertures 12, etc., are illustrated with solid lines though they should be illustrated with broken lines because they are within the actuator unit 21 or the passage unit 4. Further, in FIG. 6, for convenience of explanation, feeding pads 55*a*, 55*b*, 55*c* provided on a side of the FPC 136 attached on the upper face of the actuator unit 21 are drawn.

As shown in FIG. 5 and FIG. 6, a number of ground electrodes 38 each having a circular shape and constituting peripheral electrodes are formed in the vicinity of an outer edge portion of the upper face of the actuator unit 21. The ground electrodes 38 are spaced apart from each other such that the intervals between adjacent ones thereof are substantially equal. Therefore, a region in the upper face of the actuator unit 21, formed with the individual electrodes 35*a*, is surrounded by a number of the ground electrodes 38 over the entire periphery thereof.

Figure 7:
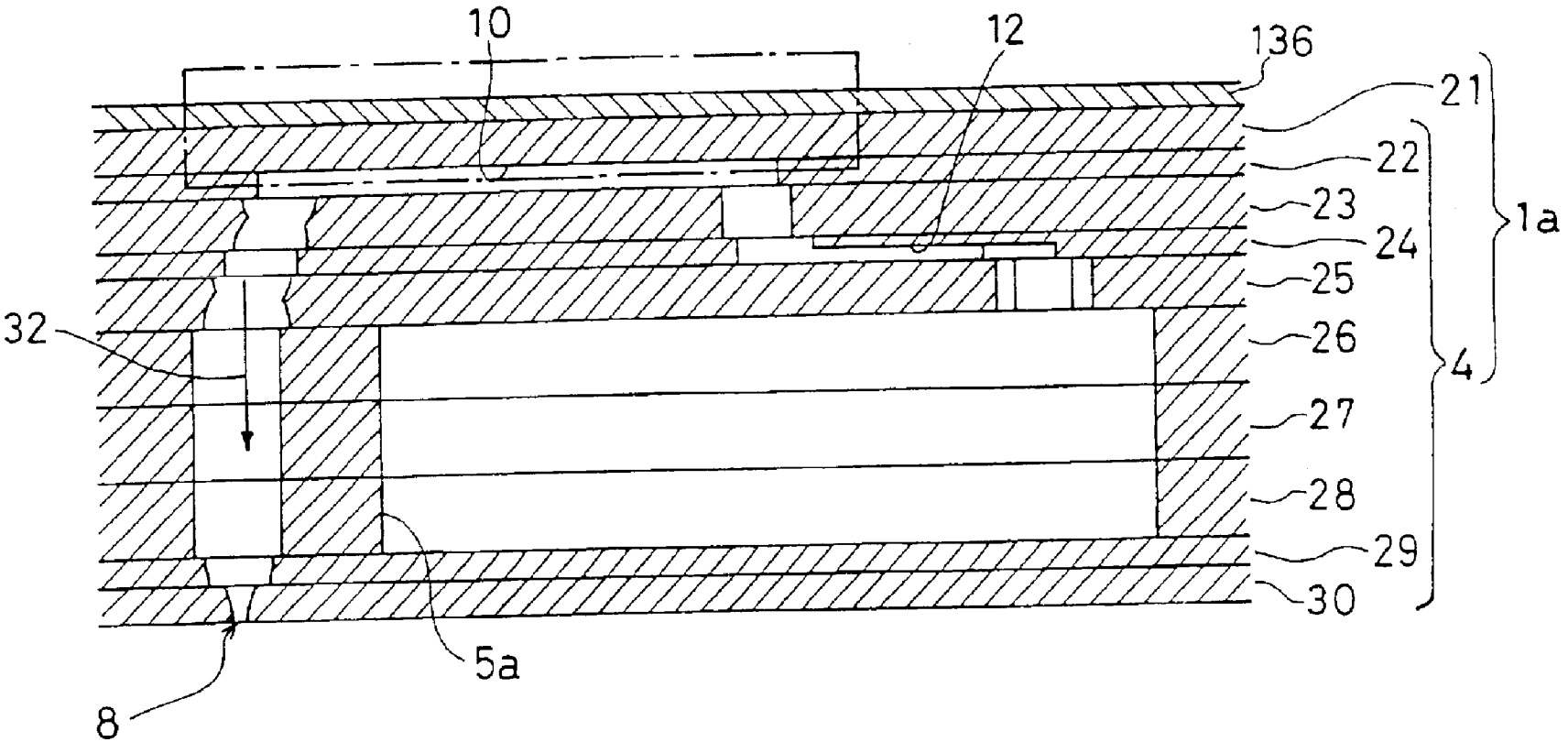
FIG. 7 is a partially sectional view of the head main body illustrated in FIG. 4 and a flexible printed circuit attached thereon.

FIG. 7 is a partial sectional view of the head main body 1*a* of FIG. 4 along the longitudinal direction of a pressure chamber and the flexible printed circuit attached thereto. As apparent from FIG. 7, each ink ejection port 8 is formed at the front end of a tapered nozzle. Each ink ejection port 8 communicates with a sub-manifold channel 5*a* through a pressure chamber 10 (length: 900 microns, width: 350 microns) and an aperture 12. Thus, formed within the ink-jet head 1 are ink passages 32, each extending from an ink tank to an ink ejection port 8 through an ink reservoir 3, a manifold channel 5, a sub-manifold channel 5*a*, an aperture 12, and a pressure chamber 10.

Referring to FIG. 7, the pressure chamber 10 and the aperture 12 are provided at different levels. Therefore, in the portion of the passage unit 4 corresponding to the ink ejection region under an actuator unit 21, an aperture 12, communicating with one another pressure chamber 10, can be disposed within the same portion in plan view as another pressure chamber 10, neighboring the pressure chamber 10 communicating with the aperture 12. As a result, since pressure chambers 10 can be arranged close to each other at a high density, image printing at a high resolution can be realized with an ink-jet head 1 having a relatively small occupation area.

In the plane of FIGS. 5 and 6, pressure chambers 10 are arranged within an ink ejection region in two directions, i.e., a direction along the longitudinal direction of the ink-jet head 1 (first arrangement direction) and a direction somewhat inclined to the lateral direction of the ink-jet head 1 (second arrangement direction). The first and second arrangement directions form an angle theta somewhat smaller than a right angle. The ink ejection ports 8 are arranged at 50 dpi in the first arrangement direction. The pressure chambers 10 are arranged in the second arrangement direction such that the ink ejection region corresponding to one actuator unit 21 includes twelve pressure chambers 10. Therefore, within the whole width of the ink-jet head 1, in a region of the interval between two ink ejection ports 8 neighboring each other in the first arrangement direction, there are twelve ink ejection ports 8. At both ends of each ink ejection region in the first arrangement direction (corresponding to an oblique side of the actuator unit 21), the above arrangement is satisfied by arranging the two lines of actuators 21 so that the oblique sides of the neighboring actuator units 21 overlap each other. Therefore, in the ink-jet head 1, by ejecting ink droplets in order through a large number of ink ejection ports 8 arranged in the first and second directions, and with relative movement of an image recording medium along the lateral direction of the ink-jet head 1, printing at 600 dpi in the main scanning direction can be performed.

Figure 8:
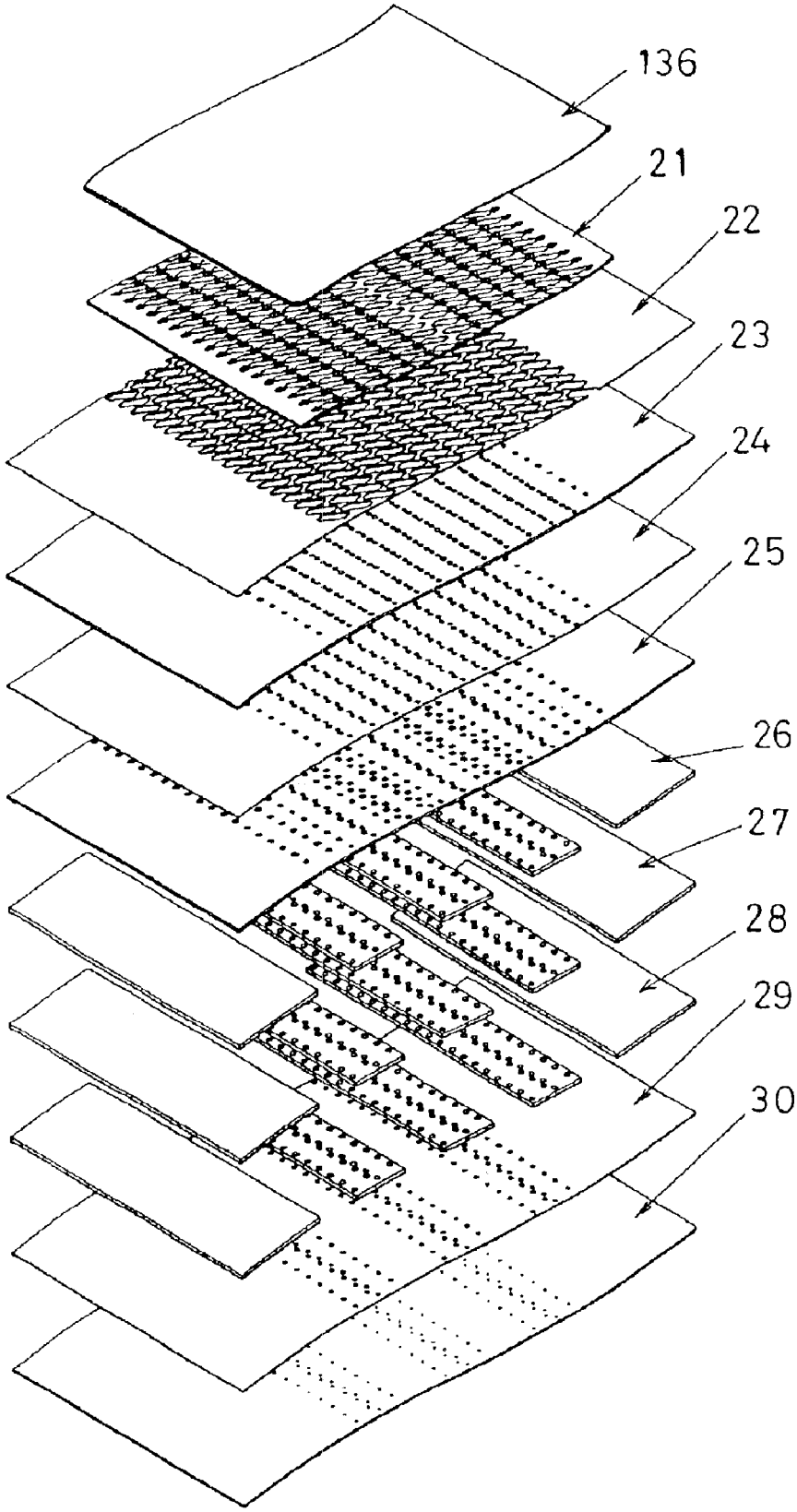
FIG. 8 is a partially exploded perspective view of the head main body illustrated in FIG. 4 and the flexible printed circuit attached thereon.

FIG. 8 is a partially exploded perspective view of the head main body illustrated in FIG. 4 and the FPC 136 attached thereon. As shown in FIG. 7 and FIG. 8, a principal portion on the bottom side of the ink-jet head 1 has a layered structure laminated with a total of eleven sheets materials in total, i.e., from the top, the FPC 136, the actuator unit 21, a cavity plate 22, a base plate 23, an aperture plate 24, a supply plate 25, manifold plates 26,27,28, a cover plate 29, and the nozzle plate 30. Of them, nine plates, other than the actuator unit 21 and the FPC 136, constitute a passage unit 4.

As described later in detail, the actuator unit 21 is laminated with five piezoelectric sheets and provided with electrodes so that three layers include active portions when an electric field is applied (hereinafter, simply referred to as "layer including active layers (active portions)") and the remaining two layers are inactive. The cavity plate 22 is made of metal, in which a large number of substantially rhombic openings are formed corresponding to the respective pressure chambers 10. The base plate 23 is made of metal, in which a communication hole between each pressure chamber 10 of the cavity plate 22 and the corresponding aperture 12, and a communication hole between the pressure chamber 10 and the corresponding ink ejection port 8 are formed. The aperture plate 24 is made of metal, in which, in addition to apertures 12, communication holes are formed for connecting each pressure chamber 10 of the cavity plate 22 with the corresponding ink ejection port 8. The supply plate 25 is made of metal, in which communication holes between each aperture 12 and the corresponding sub-manifold channel 5*a* and communication holes for connecting each pressure chamber 10 of the cavity plate 22 with the corresponding ink ejection port 8 are formed. Each of the manifold plates 26, 27, and 28 is made of metal, which defines an upper portion of each sub-manifold channel 5*a* and in which communication holes are formed for connecting each pressure chamber 10 of the cavity plate 22 with the corresponding ink ejection port 8. The cover plate 29 is made of metal, in which communication holes are formed for connecting each pressure chamber 10 of the cavity plate 22 with the corresponding ink ejection port 8. The nozzle plate 30 is made of metal, in which tapered ink ejection ports 8 each functioning as a nozzle are formed for the respective pressure chambers 10 of the cavity plate 22.

These ten sheets 21 to 30 are put in layers and positioned relative to one another to form such an ink passage 32 as illustrated in FIG. 7. The ink passage 32 first extends upward from the sub-manifold channel 5*a*, then extends horizontally in the aperture 12, further extends upward, then again extends horizontally in the pressure chamber 10, it extends obliquely downward in a certain length angling away from the aperture 12, and then extends vertically downward toward the ink ejection port 8.

Figure 9A:
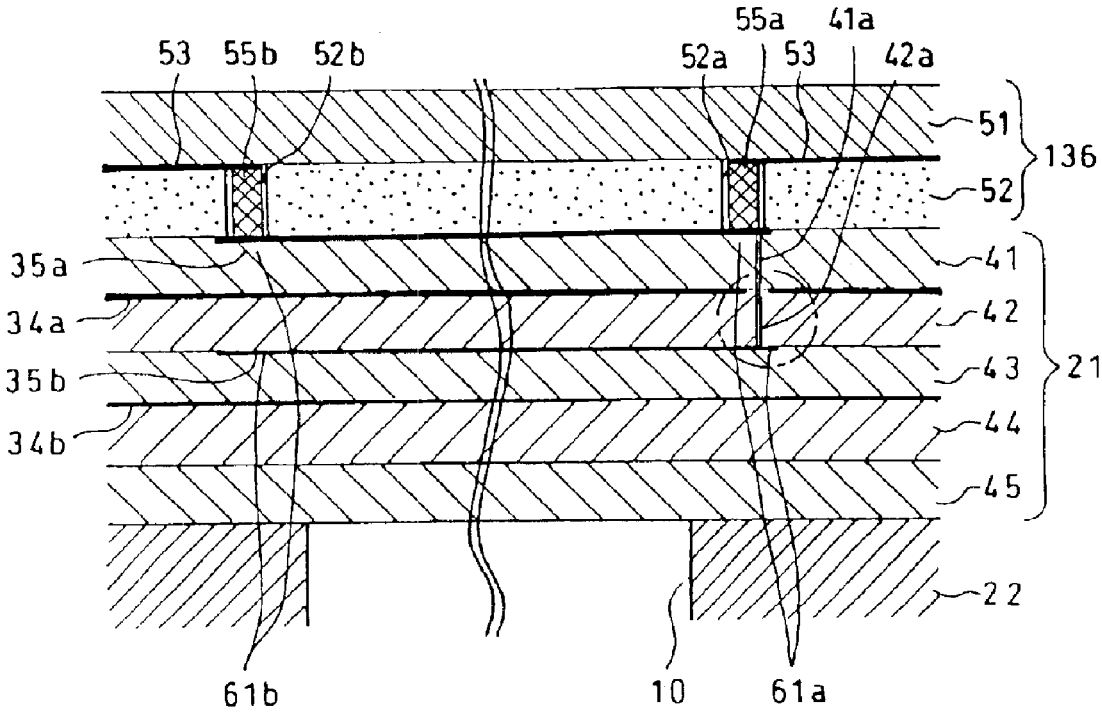
FIG. 9A is a sectional view of an actuator unit attached with the flexible printed circuit taken along a line IXA—IXA illustrated in FIG. 6 and is an enlarged view of a region surrounded by an alternate long and short dash line illustrated in FIG. 7.
Figure 9B:
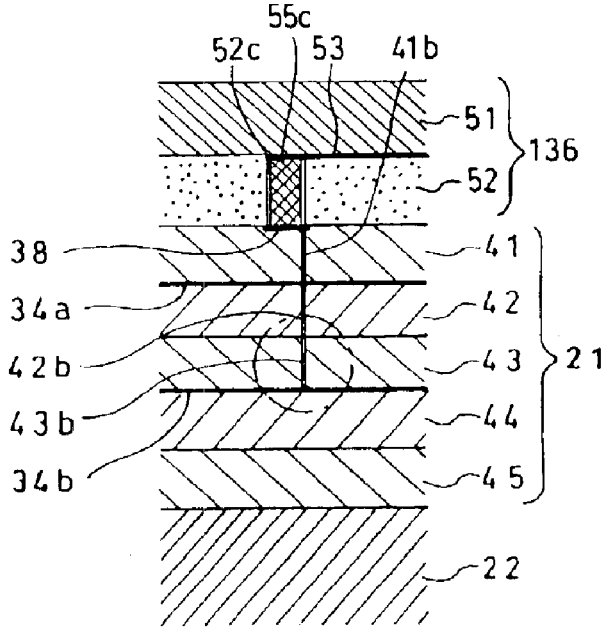
FIG. 9B is a sectional view of the actuator unit attached with the flexible printed circuit taken along a line IXB—IXB illustrated in FIG. 6.
Figure 9C:
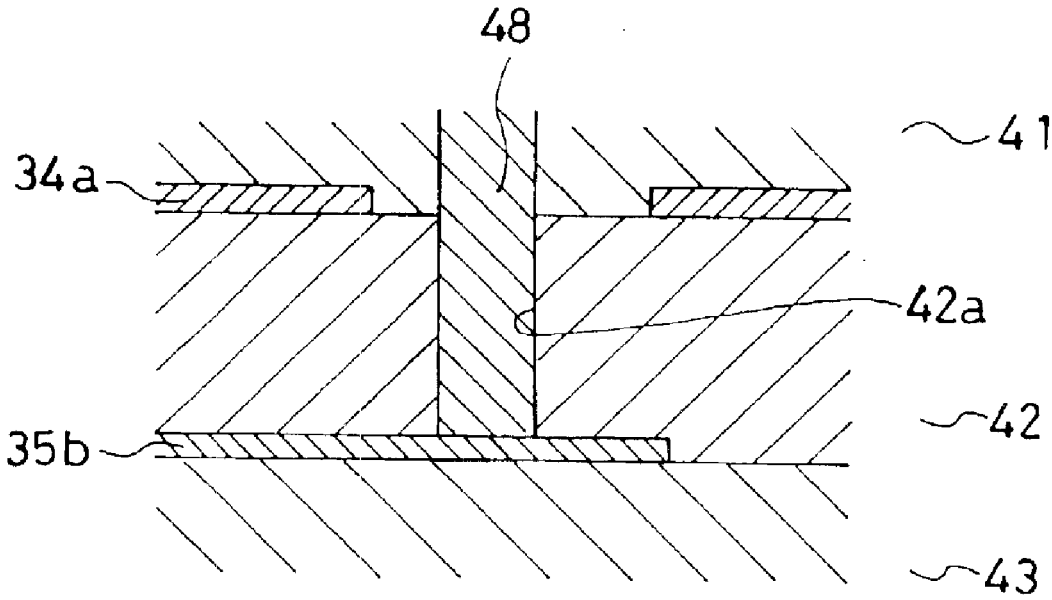
FIG. 9C is an enlarged view of a circular frame illustrated by an alternate long and short dash line of FIG. 9A.
Figure 9D:
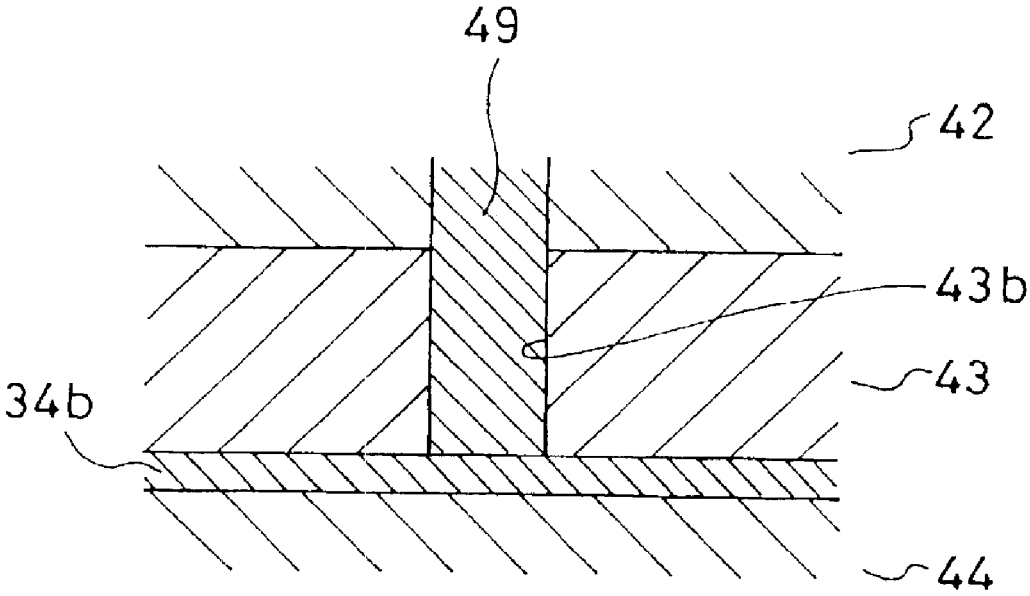
FIG. 9D is an enlarged view of a circular frame illustrated by an alternate long and short dash line of FIG. 9B.

Next, an explanation will be given of a structure of the actuator unit 21 and the connection between the actuator unit 21 and the FPC 136. FIG. 9A is a sectional view of the actuator unit attached to the FPC 136 taken along a line IXA—IXA as illustrated in FIG. 6 and is an enlarged view of a region surrounded by an alternate long and short dash line illustrated in FIG. 7. FIG. 9B is a sectional view of the actuator unit attached to the FPC 136 taken along a line IXB—IXB as illustrated in FIG. 6. FIG. 9C is an enlarged view of a circular frame illustrated by an alternate long and short dash line in FIG. 9A. FIG. 9D is an enlarged view of a circular frame illustrated by an alternate long and short dash line in FIG. 9B.

Referring to FIG. 9A and FIG. 9B, the actuator unit 21 includes five piezoelectric sheets 41, 42, 43, 44, 45 having the same thickness of about 15 microns. These piezoelectric sheets 41 to 45 are made into a continuous layered flat plate (continuous flat layers) that is disposed so as to extend over many pressure chambers 10 formed within one ink ejection region in the ink-jet head 1. Because the piezoelectric sheets 41 to 45 are disposed so as to extend over many pressure chambers 10 as continuous flat layers, the individual electrodes 35*a* and 35*b* can be arranged at a high density by using, e.g., a screen printing technique. Therefore, the pressure chambers 10, formed at positions corresponding to the individual electrodes 35*a* and 35*b*, can be arranged at a high density. This makes it possible to print a high-resolution image.

In this embodiment, each of the piezoelectric sheets 41 to 45 is made of, for example, a lead zirconate titanate (PZT)-base ceramic material having ferroelectricity. Although in FIG. 7 and FIG. 9A, it is described that the FPC 136 and the piezoelectric sheets 41 are adhered to each other over the entire surface thereof, they are actually not adhered at the main electrode portion 60 of each individual electrode 35*a*. This is to prevent the FPC 136, attached to the main electrode portion 60, from obstructing the deformation of the actuator unit 221 relative to the pressure chamber 10. The same is true of the second embodiment described later with reference to FIGS. 11A–11D.

Between the uppermost piezoelectric sheet 41 and the piezoelectric sheet 42, neighboring downward the piezoelectric sheet 41, an about 2 microns thick common electrode 34*a* is interposed and formed on the whole of both the lower and upper faces of piezoelectric sheets 41 and 42. The common electrode 34*a* is a conductive sheet extended over substantially the entire region of a single actuator unit 21. Also, between the piezoelectric sheet 43, neighboring downward the piezoelectric sheet 42, and the piezoelectric sheet 44, neighboring downward the piezoelectric sheet 43, an about 2 microns thick common electrode 34*b* is interposed and formed in the same manner as the common electrode 34*a*, on the whole of both the lower and upper faces of piezoelectric sheets 43 and 44.

In a modification of the first embodiment, many pairs of common electrodes 34*a* and 34*b*, each having a shape larger than that of a pressure chamber 10, so that the projection image of each common electrode projected along the thickness direction of the common electrode may include the pressure chamber, may be provided for each pressure chamber 10. In another modification of the first embodiment, many pairs of common electrodes 34*a* and 34*b*, each having a shape somewhat smaller than that of a pressure chamber 10, so that the projection image of each common electrode projected along the thickness direction of the common electrode may be included in the pressure chamber, may be provided for each pressure chamber 10. Thus, the common electrode 34*a* or 34*b* may not always be a single conductive sheet formed on the whole of the face of a piezoelectric sheet. In the above modifications of the first embodiment, however, all of the common electrodes must be electrically connected with one another so that the portion corresponding to any pressure chamber 10 may be at the same potential.

Figure 10:
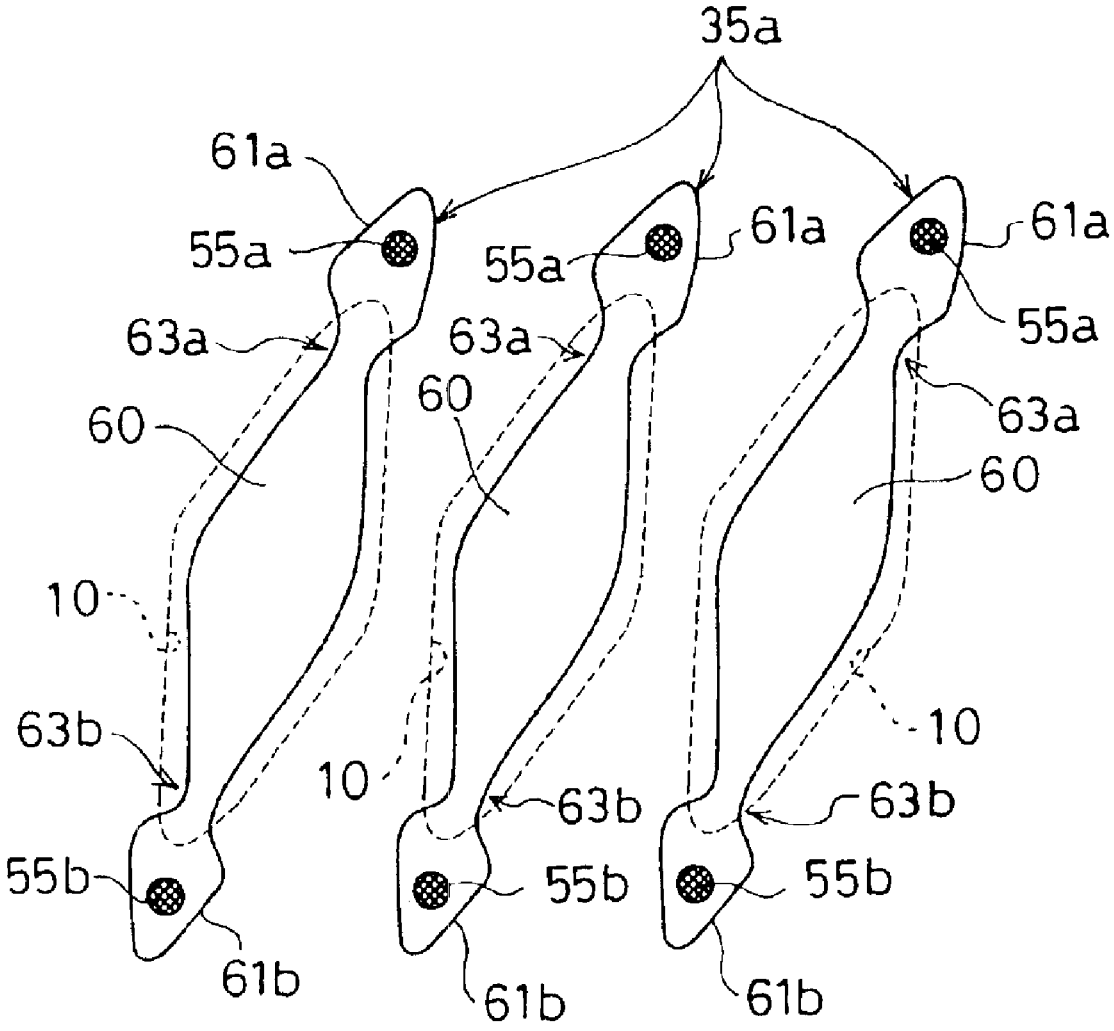
FIG. 10 is a schematic partially enlarged plane view of FIG. 6.

As shown in FIG. 9A, the individual electrode 35*a* having a thickness of about 1 microns is formed on the upper face of the piezoelectric sheets 41 at a position corresponding to the pressure chamber 10. As shown in FIG. 10, which is a schematic partially enlarged plane view of FIG. 6, the individual electrode 35*a* includes a substantially rhombic main electrode portion (length:850 microns, width: 250 microns) 60 having a shape substantially similar to that of the pressure chamber 10, and two substantially rhombic auxiliary electrode portions 61*a* and 61*b* having a shape smaller than the main electrode portion 60. The auxiliary electrode portions 61*a* and 61*b* are formed continuously from each acute portion of the main portion 60 at both ends thereof. The image of the main electrode portion 60 projected along the lamination direction is included within the corresponding pressure chamber region (the region surrounded by broken lines in FIG. 10). Meanwhile, the image of the auxiliary electrode portion 61*a*, 61*b* projected along the lamination direction are mostly excluded from the pressure chamber region.

As is apparent from FIG. 10, the width of a interconnecting part 63*a* for connecting the main electrode portion 60 and the auxiliary electrode portion 61*a* (length with respect to the direction orthogonal to the direction connecting the two auxiliary electrode portions 61*a*, 61*b*) is smaller than both the width of the main electrode portion 60 and the width of the auxiliary electrode portion 61*a* in the individual electrode 35*a*. Similarly, the width of a interconnecting part 63*b* for connecting the main electrode portion 60 and the auxiliary electrode portion 61*b* is smaller than both the width of the main electrode portion 60 and the width of the auxiliary electrode portion 61*b*. That is, in the individual electrode 35*a*, the interconnecting parts 63*a*, 63*b* for connecting the main electrode portion 60 and the auxiliary electrode portions 61*a*, 61*b* constitute a constricted shape. When compared to the main electrode portion 60 and the auxiliary electrode portions 61A, 61B.

Because the interconnecting parts 63*a*, 63*b* constitute a constricted shape, the range of the active layer corresponding to the interconnecting parts 63*a*, 63*b* is reduced. Therefore, compared to the case in which the interconnecting parts 63*a*, 63*b* do not constitute a constricted shape (i.e., the main electrode portion 60 and the auxiliary electrode portions 61*a*, 61*b* are connected with a broad width), the distance between the adjacent pressure chambers 10 is increased. Reducing "crosstalk" from occurring between the adjacent pressure chambers 10.

As seen in FIG. 9A, the individual electrode 35*b*, having a shape similar to the individual electrode 35*a* and having a thickness of about 2 microns, is interposed at a position corresponding to the individual electrode 35*a* between the piezoelectric sheet 42 and piezoelectric sheet 43. The individual electrode 35*b* is also provided with a constricted shape similar to the individual electrode 35*a* and, therefore, the crosstalk restraining effect can be achieved in the same regard. No electrode is arranged between the piezoelectric sheet 44 and the piezoelectric sheet 45, neighboring downward thereof, or on the lower side of the piezoelectric sheet 45.

As shown in FIG. 9A, through holes 41*a*, 42*a* are formed in the piezoelectric sheets 41, 42 between positions corresponding to the auxiliary electrode portions 61*a* of the individual electrode 35*a* and the individual electrode 35*b*. As shown in FIG. 9C, the through holes 41*a* and 42*a* are filled with a conductive material (e.g., silver palladium) 48. The individual electrode 35*a* and the individual electrode 35*b* are connected to each other via the conductive material 48.

As shown in FIG. 9B, through holes 41*b*, 42*b*, 43*b* penetrating the piezoelectric sheets 41, 42, 43 are formed below the ground electrode 38. As shown in FIG. 9B, the through holes 41*b*, 42*b*, 43*b* are filled with a conductive material (e.g., silver palladium) 49. The ground electrode 38 is connected to the common electrode 34*a* and the common electrode 35*b* via the conductive material 49. In this embodiment, each of the electrodes 34*a*, 34*b*, 35*a*, and 35*b* is made of, for example, an Ag—Pd-base metallic material.

The FPC 136 is a member for connecting the individual electrodes 35*a*, 35*b* and the common electrodes 34*a*, 34*b* of the actuator unit 21 to the driver IC 132. As shown in FIG. 9A and FIG. 9B, the FPC 136 includes a number of feeding pads 55*a*, 55*b*, 55*c* at a lower face thereof, which are electrically bonded by soldering to the individual electrode 35*a* and the ground electrode 38, arranged at the upper face of the actuator unit 21.

As shown in FIG. 9A and FIG. 9B, the FPC 136 includes a base film 51, a cover film 52 attached to the base film 51, and printed wirings 53 formed in a pattern between the two films 51, 52. The printed wirings 53 are separately connected to the driver IC 132 for each pressure chamber 10. Both the base film 51 and the cover film 52 are insulating sheet-like members. The FPC 136 is arranged such that the cover film 52 is brought into contact with the upper face of the piezoelectric sheet 41 disposed at the topmost layer of the actuator unit 21.

The cover film 52 is selectively formed with through holes 52*a*, 52*b*, 52*c*. The feeding pads 55*a*, 55*b*, 55*c*, made of a conductive material, having a thickness substantially the same as that of the cover film 52 are provided on the inside of the through holes 52*a*, 52*b*, 52*c*, respectively. The feeding pads 55*a*, 55*b*, 55*c* are brought into contact with the corresponding printed wiring 53 at the bottom of the recessed portion formed by the through holes 52*a*, 52*b*, 52*c*.

As shown in FIG. 9A, the feeding pads 55*a*, 55*b* are provided slightly outside of the pressure chamber 10 in the longitudinal direction, that is, at positions corresponding to the auxiliary electrode portions 61*a*, 61*b*. The feeding pads 55*a*, 55*b* are electrically bonded to the auxiliary electrode portions 61*a*, 61*b*, respectively, by soldering. That is, in the first embodiment, a single individual electrode 35*a* is electrically connected to the FPC 136 at two electric contacts (respectively disposed at positions corresponding to the each of the feeding pads 55*a*, 55*b*). In this way, by electrically bonding the feeding pads 55*a*, 55*b* and the auxiliary electrode portions 61*a*, 61*b* of the individual electrode 35*a*, the electrical potential of the respective individual electrodes 35*a*, 35*b* can be controlled for each pressure chamber 10, independent from the other pressure chambers 10, via the printed wiring 53 and the conductive material 48 at the insides of the through holes 41*a*, 42*a*.

On the other hand, as shown in FIG. 9B, the feeding pad 55*c* is provided at a position corresponding to the ground electrode 38 formed in the vicinity of an outer edge of the actuator unit 21. The feeding pad 55*c* is electrically bonded to the ground electrode 38 by soldering. Thereby, the electrical potential of the common electrodes 34*a*, 34*b* can be maintained at the ground potential via the printed wiring 53 and the conductive material 49 at the insides of the through holes 41*b*, 42*b*, 43*b*.

In this first embodiment, many ground electrodes 38 are electrically bonded to the feeding pads 55*c* by soldering, and connected to the common electrodes 34*a*, 34*b* via the conductive material 49. However, one or several ground electrodes 38 may not be electrically bonded to the feeding pads 55*c*, and one or several ground electrodes 38 may not be connected to the common electrodes 34*a*, 34*b*. Because the common electrode 34*a* or 34*b* is formed as one sheet of a continuous flat plate extending over all of the pressure chambers 10, when at least one of the ground electrodes 38 is electrically bonded to the feeding pad 55*c* and connected to the common electrodes 34*a*, 34*b*, the potential of the common electrodes 34*a*, 34*b* can be maintained at the ground potential in the regions corresponding to all of the pressure chambers 10.

In the ink-jet head 1 according to the first embodiment, the piezoelectric sheets 41 to 43 are polarized in their thickness direction. Therefore, when the individual electrodes 35*a*, 35*b* are set at a potential different from those of the common electrodes 34*a*, 34*b*, for applying an electric field to the piezoelectric sheets 41 to 43 in the polarizing direction thereof, any portion of piezoelectric sheets 41 to 43, applied with the electric field, works as an active layer, and may be elongated or contracted in the thickness direction or the lamination direction. As a result, the active layer is to be contracted or elongated in the direction orthogonal to the lamination direction or a face direction thereof by the transversal piezoelectric effect. On the other hand, the remaining two piezoelectric sheets 44, 45 are inactive layers which are not provided with regions sandwiched between the individual electrodes 35*a*, 35*b* and the common electrodes 34*a*, 34*b* and therefore, they do not contract in themselves. That is, the actuator unit 21 has a so-called unimorph structure in which the upper (i.e., distant from the pressure chamber 10) three piezoelectric sheets 41 to 43 are layers wherein active layers are present, and the lower (i.e., near the pressure chamber 10) two piezoelectric sheets 44 and 45 are made into inactive layers.

Therefore, when the individual electrodes 35*a*, 35*b* are set at a positive or negative predetermined potential by controlling the driver IC 132, such that an electric field is in the same direction as the polarization, the corresponding active layers of the piezoelectric sheets 41 to 43 sandwiched between the individual electrodes 35*a*, 35*b* and the common electrodes 34*a*, 34*b* are contracted perpendicular to the polarization. However, the piezoelectric sheets 44, 45 do not contract in themselves. At this time, as illustrated in FIG. 9A, the lowermost face of the piezoelectric sheets 41 to 45 is fixed to the upper face of the partition separating pressure chambers 10, as a result, the piezoelectric sheets 41 to 45 deform into a convex shape toward the pressure chamber side based on the transversal piezoelectric effect. Therefore, the volume of the pressure chamber 10 is decreased to raise the pressure of ink. The ink is thereby ejected through the ink ejection port 8. After this, when the individual electrodes 35*a* and 35*b* are returned to the same potential as that of the common electrodes 34*a* and 34*b*, the piezoelectric sheets 41 to 45 return to their original shape and the pressure chamber 10 returns to its original volume. Thus, the pressure chamber 10 sucks ink therein through the manifold channel 5.

In another driving method, all the individual electrodes 35*a* and 35*b* are set in advance at a different potential from that of the common electrodes 34*a* and 34*b*. When an ejecting request is issued, the corresponding pair of individual electrodes 35*a* and 35*b* is once set at the same potential as that of the common electrodes 34*a* and 34*b*. After this, at a predetermined timing, the pair of individual electrodes 35*a* and 35*b* is again set at the different potential from that of the common electrodes 34*a* and 34*b*. In this case, at the point in time when the pair of individual electrodes 35*a* and 35*b* is set at the same potential as that of the common electrodes 34*a* and 34*b*, the piezoelectric sheets 41 to 45 return to their original shapes. The corresponding pressure chamber 10 is thereby increased in volume from its initial state (the state that the potentials of both electrodes differ from each other), to suck ink from the manifold channel 5 into the pressure chamber 10. After this, at the point in time when the pair of individual electrodes 35*a* and 35*b* is again set at the different potential from that of the common electrodes 34*a* and 34*b*, the piezoelectric sheets 41 to 45 deform into a convex shape toward the pressure chamber 10. The volume of the pressure chamber 10 is thereby decreased and the pressure of ink in the pressure chamber 10 increases to eject ink.

However, in a case that the polarization occurs in the reverse direction to the electric field applied to the piezoelectric sheets 41 to 43, the active layers in the piezoelectric sheets 41 to 43 sandwiched by the individual electrodes 35*a* and 35*b* and the common electrodes 34*a* and 34*b* are ready to elongate perpendicular to the polarization by the transversal piezoelectric effect. As a result, the piezoelectric sheets 41 to 45 deform into a concave shape toward the pressure chamber 10. Therefore, the volume of the pressure chamber 10 is increased to suck ink from the manifold channel 5. After this, when the individual electrodes 35*a* and 35*b* return to their original potential, the piezoelectric sheets 41 to 45 also return to their original flat shape. The pressure chamber 10 thereby returns to its original volume to eject ink through the ink ejection port 8.

As described above, according to the ink-jet head 1 of the first embodiment, the individual electrode 35*a* provided on the piezoelectric sheet 41 most distant from the pressure chamber 10 and the FPC 136 are directly connected and electrically bonded by soldering at a total of two electric contacts, i.e., an electric contact between the auxiliary electrode portion 61*a* and the feeding pad 55*a* and an electric contact between the auxiliary electrode portion 61*b* and the feeding pad 55*b*. Therefore, even when the individual electrode 35*a* and the FPC 136 have not been electrically bonded at one of the electric contacts, or one of the two electric contact is released, the electric connection between the individual electrode 35A and the FPC 136 is ensured. Therefore, reliability of the electric connection between the individual electrode 35*a* and the FPC 136 is promoted and the ink-jet head 1 and the ink-jet printer 101 having the ink-jet head 1 are less likely to fail.

Further, in this first embodiment, the individual electrode 35*a* is arranged at a position corresponding to each pressure chamber 10 on a face of the piezoelectric sheet 41 most distant from the pressure chamber 10 facing the direction opposite to the pressure chamber 10. Also, the feeding pads 55*a*, 55*b* provided on the FPC 136 are electrically bonded by soldering to the individual electrode. Therefore, it is not necessary to extend conductive members, each of which are continuously connected to the corresponding individual electrode 35*a*, along the upper face of the piezoelectric sheet 41 up to an end portion thereof for electrical bonding with the FPC 136 at a side face of the actuator unit 21. Such a separate conductive member is formed to avoid the individual electrode 35*a* disposed above the piezoelectric sheet 41 and therefore, in order to sufficiently ensure electric insulating performance, it is necessary to sufficiently ensure a space between the individual electrodes 35*a*. Therefore, as a result of using a separate conductive member, the number of the pressure chambers 10 in a predetermined area is reduced. Further, such a separate conducting member may obstruct deformation of the piezoelectric sheets 41 to 45 in the lamination direction. According to the first embodiment, as described above, because the individual electrode 35*a* and the FPC 136 can be electrically connected without providing a separated conductive member, the number of the pressure chambers 10 in a predetermined area can be increased and a displacement of the piezoelectric sheets 41 to 45 in the lamination direction can be increased.

Additionally, according to ink-jet head 1 of the first embodiment, both of the electric contacts, provided at two locations between the auxiliary electrode portion 61*a* and the feeding pad 55*a* and between the auxiliary electrode portion 61*b* and the feeding pad 55*b*, correspond to a region outside of the pressure chamber 10. Thus, deformation of the main electrode portion 60, corresponding to the region at the inside of the pressure chamber 10 of the individual electrode 35*a* in the lamination direction, is unobstructed by the feeding pads 55*a*, 55*b*. As a result, the main electrode portion 60 of the individual electrode 35*a* can be considerably deformed in the lamination direction against inner pressure of the pressure chamber 10. Accordingly, variation of the volume in the pressure chamber 10 is increased and a sufficient amount of ink can be ejected, even when the pressure chambers 10 are highly integrated by reducing the size of the pressure chamber 10.

Because the ground electrode 38 arranged at the periphery of a region formed with the individual electrode 35*a* on the piezoelectric sheet 41 electrically bonded to the FPC 136, having the feeding pads 55*a*, 55*b* electrically connected to the individual electrode 35*a* by soldering, when an external force for peeling off the FPC 136 is exerted, only after releasing the electric bonding between the FPC 136 and the ground electrodes 38, is the electric bonding between the individual electrode 35*a* and the feeding pads 55*a*, 55*b* is released. Therefore, unless a comparatively large force is exerted, the electric bonding between the individual electrode 35*a* and the feeding pads 55*a*, 55*b* are not released. As a result, reliability of the electric connection is promoted, and the ink-jet head 1 and the ink-jet printer 101 having the ink-jet head 1 are less likley to fail.

Further, according to the ink-jet head 1 of the first embodiment, the structure, which is for preventing the electric bonding between the individual electrode 35*a* and feeding pads 55*a*, 55*b* from releasing, partially serves as a feeding structure for maintaining the common electrodes 34*a*, 34*b* at ground potential. Therefore, the structure of the ink-jet head 1 is simplified.

Further, a region formed with the individual electrode 35*a* on the piezoelectric sheet 41 is surrounded by a number of the ground electrodes 38 and therefore, even when the force for peeling off the FPC 136 is a force from any direction, the electric bonding between the individual electrode 35A and the FPC 136 are difficult to release. Thus, reliability of the electric connection between each individual electrode 35*a* and the corresponding feeding pads 55*a*, 55*b* is promoted.

Further, because the FPC 136 is used as an electricity feeding member, the head main body 1*a* and the driver IC 132 are easily connected electrically. Although the FPC 136 is liable to be subject to an external force for peeling off the FPC 136, the bonding strength of the FPC 136 is promoted and the reliability of the electric connection is enhanced, as described above, by electrically bonding the individual electrode 35*a* with the FPC 136 at two of the electric contacts for each pressure chamber 10 and by the actuator unit 21 with the FPC 136 at a number of the ground electrodes 38.

Although, according to the first embodiment, the electric contacts between the individual electrode 35*a* and the FPC 136 are provided at two locations corresponding to the vicinity of each end of each pressure chamber 10 three or more electric contacts may be provided for each of the individual electrodes 35*a*. Further still, the positions of each electric contact can arbitrarily be changed. However, it is more preferable that the electric contacts are arranged to be comparatively distant from each other as in the first embodiment than in the case of arranging the electric contacts to be proximate to each other.

In the first embodiment, the ground electrode 38 may not be arranged at the periphery of the region where the individual electrodes 35*a* are present. Alternatively, the individual electrode 35*a* formed on the piezoelectric sheet 41 may be electrically bonded to the FPC 136 at an electric contact (either one of the feeding pads 55*a*, 55*b*) in the first embodiment, while a plurality of the ground electrodes 38 are arranged at the periphery of the region in which the individual electrodes 35*a* are present and the ground electrodes 38 are electrically bonded to the FPC 136.

Furthermore, in the present embodiment, only two or more ground electrodes 38 may be arranged at the periphery of the region in which the individual electrodes are formed. The number and arrangement of the ground electrodes 38 may be arbitrarily changed. Therefore, it is not necessary that the ink ejection region is surrounded by the ground electrodes 38 over the entire periphery thereof.

Although the ground electrodes 38 are connected to the common electrode 34*a* via the conductive material 49 provided at the inside of the through hole 41*b* in the present embodiment, conductive members for extending each of the ground electrodes and the common electrodes to an end portion of the piezoelectric sheet may be formed. In this case, the conductive members may be connected to the FPC 136 at the end portion of the piezoelectric sheet.

Figure 11A:
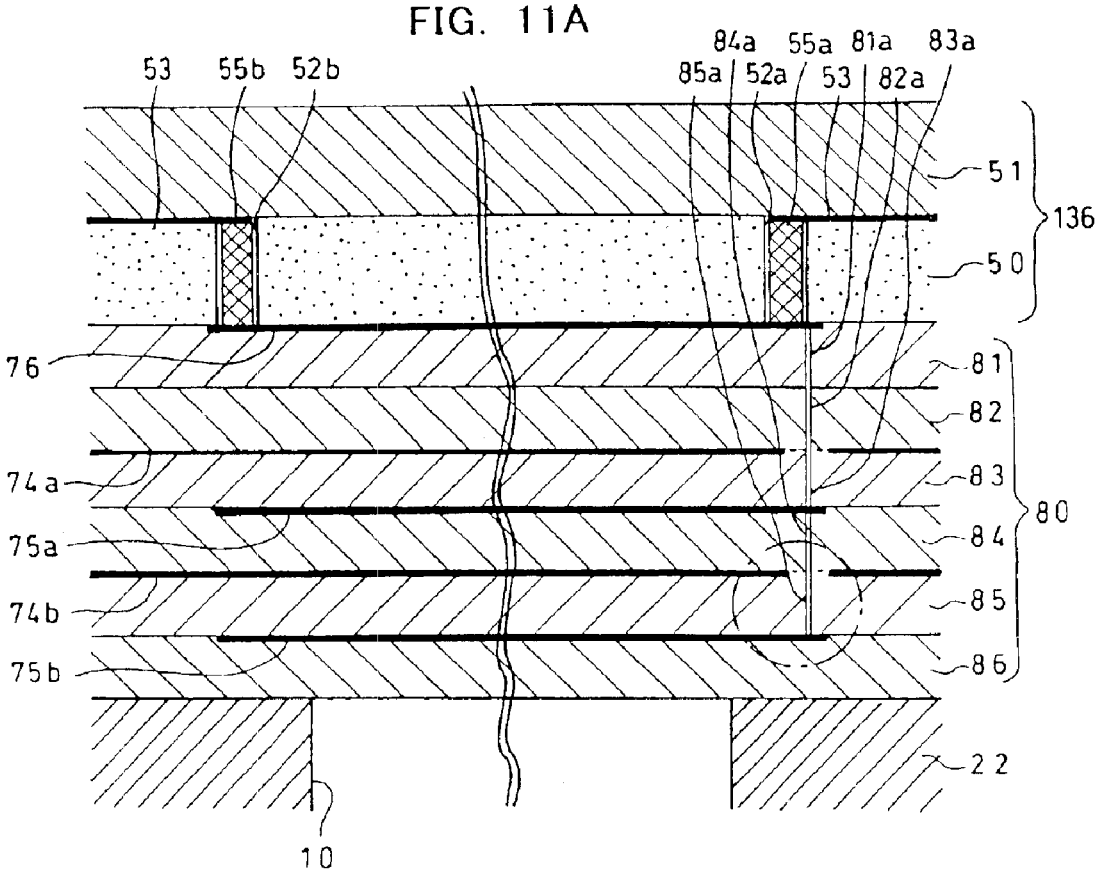
FIG. 11A is a sectional view corresponding to FIG. 9A of an ink-jet head according to a second embodiment of the invention.
Figure 11B:
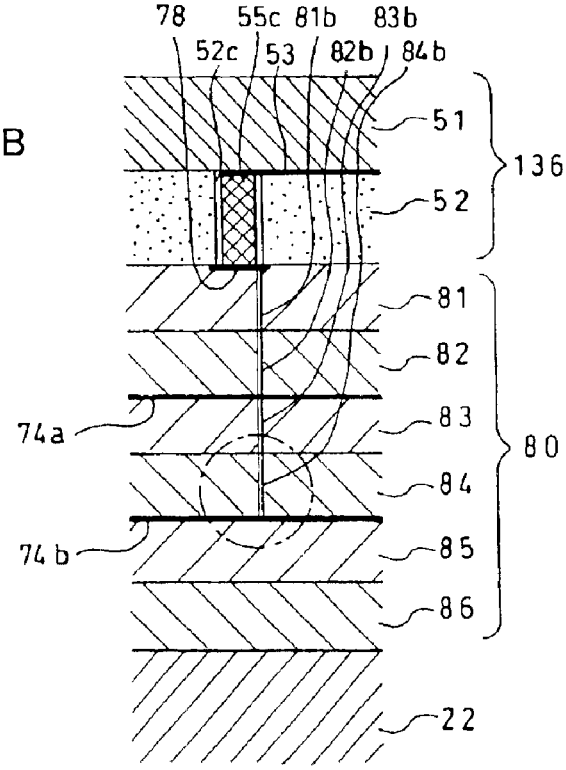
FIG. 11B is a sectional view corresponding to FIG. 9B of the ink-jet head according to the second embodiment of the invention.
Figure 11C:
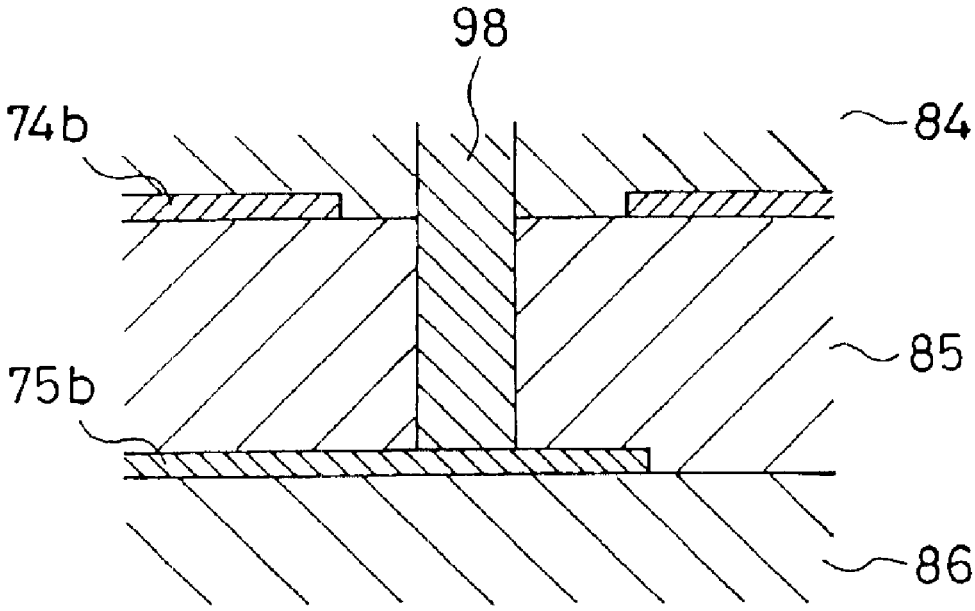
FIG. 11C is an enlarged view of a circular frame illustrated by an alternate long and short dash line of FIG. 11A.
Figure 11D:
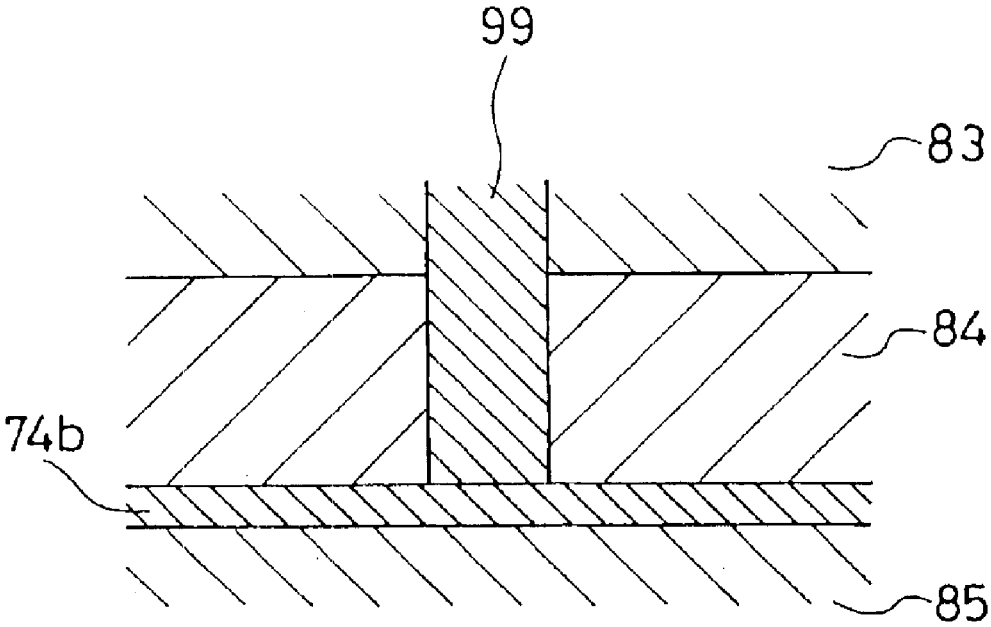
FIG. 11D is an enlarged view of a circular frame illustrated by an alternate long and short dash line of FIG. 11B.

Next, a second embodiment of the invention will be explained in reference to FIG. 11A to FIG. 11D. FIG. 11A and FIG. 11B are sectional views of an ink-jet head according to the second embodiment corresponding to FIG. 9A and FIG. 9B of the first embodiment. FIG. 11C is an enlarged view of a circular frame illustrated by an alternate long and short dash line of FIG. 11A. FIG. 11D is an enlarged view of a circular frame illustrated by an alternate long and short dash line of FIG. 11B. In this second embodiment, components that are similar to those in the above-described first embodiment are denoted by the same reference numerals as in the first embodiment, and an explanation thereof will be omitted.

The main distinction between the first embodiment and the second embodiment is the use of surface electrodes 76. According to the first embodiment, the individual electrodes 35*a* are arranged on the face of the piezoelectric sheet 41 including the active layer most distant from the pressure chamber 10, facing the direction opposite to the pressure chamber 10. However, according to this second embodiment, as shown in FIG. 11A, surface electrodes 76 are arranged, in place of individual electrodes, on the face of a piezoelectric sheet 81 most distant from the pressure chamber 10 among six sheets of piezoelectric sheets 81 to 86 included in an actuator unit 80 facing the direction opposite to the pressure chamber 10.

The structure of the actuator unit 80 in the ink-jet head according to the embodiment will be described in detail as follows. As shown in FIG. 11A and FIG. 11B, the actuator unit 80 includes six piezoelectric sheets 81, 82, 83, 84, 85, 86. The piezoelectric sheets 81 to 86 are continuous flat plate layers, which are arranged to extend over a plurality of pressure chambers 10 formed within one ink ejection region corresponding to the actuator unit 80 in the ink-jet head.

Between the second piezoelectric sheet 82, neighboring the uppermost layer, and the piezoelectric sheet 83, neighboring downward the piezoelectric sheet 82, an about 2 microns thick common electrode 74*a* is interposed. The common electrode 74*a* is a conductive sheet extended over substantially the entire region of a single actuator unit 80. Also, between the piezoelectric sheet 84, neighboring downward the piezoelectric sheet 83, and the piezoelectric sheet 85, neighboring downward the piezoelectric sheet 84, an about 2 microns thick common electrode 74*b* is interposed formed like the common electrode 74*a*.

As shown in FIG. 11A, about 2 microns thick individual electrodes 75*a*, each having a shape similar to that of the individual electrode 35*a* having the main electrode portion 60 and the two auxiliary electrode portions 61*a*, 61*b* on both sides thereof as shown in FIG. 10, are interposed between the piezoelectric sheet 83 and the piezoelectric sheet 84 at a position corresponding to the respective pressure chambers 10. Also, between the piezoelectric sheet 85 and the piezoelectric sheet 86, about 2 microns thick individual electrodes 75*b*, each having a shape similar to that of the individual electrode 75*a*, are interposed at a position corresponding to the respective individual electrodes 75*a*.

Further, on the upper face of the piezoelectric sheet 81 constituting the topmost layer, about 1 microns thick surface electrodes 76, each having a shape similar to that of the individual electrode 75*a*, are formed at a position corresponding to the respective pressure chambers 10. No electrode is provided between the piezoelectric sheet 81 and the piezoelectric sheet 82 neighboring downward the piezoelectric sheet 81.

As shown in FIG. 11A, through holes 81*a*, 82*a*, 83*a*, 84*a*, 85*a* are formed to penetrate the piezoelectric sheets 81 to 85 respectively at a position corresponding to the auxiliary electrode portion of the individual electrode 75*a* and the individual electrode 75*b* on the same side of the individual electrode 75A. As shown in FIG. 11C, the through holes 81*a*, 82*a*, 83*a*, 84*a*, 85*a* are filled with a conductive material (e.g., silver palladium) 98. The surface electrode 76, the individual electrode 75*a*, and the individual electrode 75*b* are connected to each other via the conductive material 98.

On the piezoelectric sheet 81, a number of ground electrodes 78 each having a circular shape similar to the ground electrode 38 shown in FIG. 5 and FIG. 6 are formed in the vicinity of an outer edge portion of the upper face of the actuator unit 80. The ground electrodes 78 are spaced apart from each other such that intervals between adjacent ones thereof are substantially equal. Therefore, a region formed with the surface electrodes 76 on the upper face of the actuator unit 80 is surrounded by a number of the ground electrodes 78 over the entire periphery thereof.

As shown in FIG. 11B, below the respective ground electrode 78, through holes 81*b*, 82*b*, 83*b*, 84*b* are formed to penetrate the piezoelectric sheets 81, 82, 83, 84. As shown in FIG. 11D, the through holes 81*b*, 82*b*, 83*b*, 84*b* are filled with a conductive material (e.g., silver palladium) 99. The ground electrode 78 is connected to the common electrode 74*a* and the common electrode 74*b* via the conductive material 99. Each of the electrodes 74*a*, 74*b*, 75*a*, 75*b*, 78 is made of, for example, an Ag—Pd-base metallic material.

In the second embodiment, a single surface electrode 76 is electrically bonded to the FPC 136 at two electric contacts (respectively disposed at positions corresponding to each of the feeding pads 55*a*, 55*b*). Thereby, the potential of the respective individual electrodes 75*a*, 75*b* can be controlled for each pressure chamber 10 independent from the other pressure chambers 10 via the printed wiring 53 and the conductive material 98 at the insides of the through holes 81 a to 85*a*.

On the other hand, each ground electrode 78 is electrically bonded to the feeding pad 55*c* of the FPC 136. Thereby, the potential of the common electrodes 74*a*, 74*b* can be maintained at the ground potential via the printed wiring 53 and the conductive material 99 at the insides of the through holes 81*b* to 84*b*.

In this second embodiment, the actuator unit 21 has a so-called unimorph structure in which the three piezoelectric sheets 83 to 85 are layers wherein active layers are present, and the three piezoelectric sheets 81, 82, 86, arranged to sandwich the piezoelectric sheets 83 to 85, are made into inactive layers. When the individual electrodes 75*a*, 75*b* are set at a positive or negative predetermined potential via the surface electrode 76, by controlling the driver IC 132, the electric field-applied portion in the piezoelectric sheets 83 to 85 sandwiched by the common and individual electrodes works as an active layer. As a result, the active layer elongates or contacts in the thickness direction of the sheets by the piezoelectric effect, and the volume of the pressure chamber 10 is changed to eject ink from the ink ejecting port.

In the ink-jet head of the second embodiment, the surface electrode 76, provided on the piezoelectric sheet 81, most distant from the pressure chamber 10, and the FPC 136 are directly connected and electrically bonded by soldering at the above-described two electric contacts. Therefore, even when the surface electrode 76 and the FPC 136 have not been electrically bonded at one of the electric contacts, or the electric bonding is released at one of the two electric contacts, the electric connection between the surface electrode 76 and the FPC 136 is ensured. Accordingly, reliability of the electric connection between the individual electrodes 35*a*, 35*b* and the FPC 136 is promoted and the ink-jet head 1 and the ink-jet printer 101 having the ink-jet head 1 are less likley to fail.

Furthermore, in the second embodiment, the surface electrodes 76 are arranged at the positions corresponding to each pressure chamber 10, on the face of the piezoelectric sheet 81 most distant from the pressure chamber 10, facing the direction opposite to the pressure chamber 10, and the surface electrode 76 and the feeding pads 55*a*, 55*b* provided at the FPC 136 are electrically bonded directly by soldering. Therefore, it is not necessary to separately form a conductive member for electrically connecting the surface electrode 76 and the FPC 136 along the piezoelectric sheet 81. According to the second embodiment, the surface electrode 76 and the FPC 136 can be electrically connected without providing such separate conductive member. Thus, the number of the pressure chambers 10 in a predetermined area can be increased, and a displacement of the piezoelectric sheets 81 to 86 in the lamination direction can be increased.

Other than the previously-described advantages relating specifically to the second embodiment, the advantages similar to those obtained by the first embodiment will also be achieved.

The materials of each piezoelectric sheet and each electrode used in the above-described embodiments are not limited by the above-described descriptions. They can be changed to other known materials. The shapes in plan and sectional views of each pressure chamber, the arrangement of pressure chambers, the number of piezoelectric sheets including active layers, the number of inactive layers, etc., can be properly changed, as well. The thickness of the piezoelectric sheets including the active layer and the thickness of the piezoelectric sheets which do not include the active layer may be the same or different from each other. Finally, although any inactive layer is made of a piezoelectric sheet in the above-described embodiment, the inactive layer may be made of an insulating sheet other than a piezoelectric sheet.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit including a plurality of pressure chambers each having one end connected with a nozzle and the other end to be connected with an ink supply source, the plurality of pressure chambers being arranged along a plane and neighboring each other;

an actuator unit fixed to a surface of the passage unit for chanting the volume of each of the pressure chambers; and an electricity feeding member for supplying a drive signal to the actuator unit;

wherein the actuator unit comprises:

a common electrode maintained at a constant potential;

a plurality of individual electrodes arranged at positions corresponding to each pressure chamber; and a plurality of piezoelectric sheets which are sequentially laminated, the piezoelectric sheet most distant from the pressure chamber being sandwiched between the common electrode and at least one of the individual electrodes, and each of the individual electrodes, arranged on a face of the piezoelectric sheet most distant from the pressure chamber, facing the direction opposite to the pressure chamber, being electrically bonded to the electricity feeding member at each of a plurality of electric contacts on the individual electrode.

2. The ink-jet head according to claim 1, wherein the electric contacts are provided at two locations corresponding to the vicinity of two ends of the pressure chamber.

3. The ink-jet head according to claim 1, wherein the electric contact is provided at an outer area of a region corresponding to the pressure chamber.

4. The ink-jet head according to claim 1, wherein the electricity feeding member is a flexible printed circuit.

5. The ink-jet head according to claim 1, wherein the electricity feeding member includes a plurality of feeding terminals and wherein each of the individual electrodes, which is arranged on a face of the piezoelectric sheet most distant from the pressure chamber and faces the direction opposite to the pressure chamber, includes a plurality of electric contacts, each one of the plurality of electric contacts being electrically bonded to a corresponding one of the plurality of feeding terminals.

6. An ink-jet head comprising:

a passage unit including a plurality of pressure chambers each having one end connected with a nozzle and the other end to be connected with an ink supply source, the plurality of pressure chambers being arranged along a plane and neighboring each other;

an actuator unit fixed to a surface of the passage unit for changing the volume of each of the pressure chambers; and an electricity feeding member for supplying a drive signal to the actuator unit;

wherein the actuator unit comprises:

a common electrode maintained at a constant potential;

a plurality of individual electrodes arranged at positions corresponding to each pressure chamber;

a plurality of piezoelectric sheets which are sequentially laminated, at least one of the piezoelectric sheets, other than the piezoelectric sheet most distant from the pressure chamber, being sandwiched between the common electrode and at least one of the individual electrodes; and a plurality of surface electrodes arranged on a face of the piezoelectric sheet most distant from the pressure chamber facing the direction opposite to the pressure chamber at positions corresponding to the individual electrodes, each of the surface electrodes being connected to a corresponding one of the individual electrode via a conductive material provided at the inside of a through hole penetrating a single or a plurality of the piezoelectric sheets and electrically bonded to the electricity feeding member at each of a plurality of electric contacts on the surface electrode.

7. The ink-jet head according to claim 6, wherein the electricity feeding member includes a plurality of feeding terminals and wherein each of the individual electrodes, which is arranged on a face of the piezoelectric sheet most distant from the pressure chamber and faces the direction opposite to the pressure chamber, includes a plurality of electric contacts, each one of the plurality of electric contacts being electrically bonded to a corresponding one of the plurality of feeding terminals.

8. An ink-jet head comprising:

a passage unit including a plurality of pressure chambers each having one end connected with a nozzle and the other end to be connected with an ink supply source, the plurality of pressure chambers being arranged along a plane and neighboring each other;

an actuator unit fixed to a surface of the passage unit for changing the volume of each of the pressure chambers; and an electricity feeding member for supplying a drive signal to the actuator unit;

wherein the actuator unit comprises:

a common electrode maintained at a constant potential;

a plurality of individual electrodes arranged at positions corresponding to each pressure chamber;

a plurality of piezoelectric sheets which are sequentially laminated, the piezoelectric sheet most distant from the pressure chamber being sandwiched between the common electrode and at least one of the individual electrodes, and the each of the individual electrodes arranged on a face of the piezoelectric sheet most distant from the pressure chamber facing the direction opposite to the pressure chamber being electrically bonded to the electricity feeding member; and a plurality of peripheral electrodes arranged on the face of the piezoelectric sheet most distant from the pressure chamber facing the direction opposite to the pressure chamber at the periphery of a region in which the plurality of the individual electrodes are arranged, at least one of the peripheral electrodes being electrically connected to the common electrode and electrically bonded to the electricity feeding member.

9. The ink-jet head according to claim 8, wherein the region is substantially surrounded by the peripheral electrodes.

10. The ink-jet head according to claim 8, wherein two or more of the peripheral electrodes are electrically connected to the common electrode and electrically bonded to the electricity feeding member.

11. The ink-jet head according to claim 8, wherein the electricity feeding member is a flexible printed circuit.

12. The ink-jet head according to claim 8, wherein the electricity feeding member includes a plurality of feeding terminals and wherein each of the individual electrodes, which is arranged on a face of the piezoelectric sheet most distant from the pressure chamber and faces the direction opposite to the pressure chamber, includes a plurality of electric contacts, each one of the plurality of electric contacts being electrically bonded to a corresponding one of the plurality of feeding terminals.

13. An ink-jet head comprising:

a passage unit including a plurality of pressure chambers each having one end connected with a nozzle and the other end to be connected with an ink supply source, the plurality of pressure chambers being arranged along a plane and neighboring each other;

an actuator unit fixed to a surface of the passage unit for changing the volume of each of the pressure chambers; and an electricity feeding member for supplying a drive signal to the actuator unit;

wherein the actuator unit comprises:

a common electrode maintained at a constant potential;

a plurality of individual electrodes arranged at positions corresponding to each pressure chamber;

a plurality of piezoelectric sheets which are sequentially laminated, at least one of the piezoelectric sheets other than the piezoelectric sheet most distant from the pressure chamber being sandwiched between the common electrode and at least one of the individual electrodes;

a plurality of surface electrodes arranged on a face of the piezoelectric sheet most distant from the pressure chamber facing the direction opposite to the pressure chamber at positions corresponding to the individual electrodes, each of the surface electrodes being connected to a corresponding one of the individual electrodes via a conductive material provided at the inside of a through hole penetrating a single or a plurality of the piezoelectric sheets and electrically bonded to the feeding terminal; and a plurality of peripheral electrodes arranged on the face of the piezoelectric sheet most distant from the pressure chamber facing the direction opposite to the pressure chamber at the periphery of a region in which the plurality of the surface electrodes are arranged, at least one of the peripheral electrodes being electrically connected to the common electrode and electrically bonded to the feeding terminal.

14. An ink-jet head comprising:

a passage unit including a plurality of pressure chambers each having one end connected with a nozzle and the other end to be connected with an ink supply source, the plurality of pressure chambers being arranged along a plane and neighboring each other;

an actuator unit fixed to a surface of the passage unit for changing the volume of each of the pressure chambers; and an electricity feeding member for supplying a drive signal to the actuator unit;

wherein the actuator unit comprises:

a common electrode maintained at a constant potential;

a plurality of individual electrodes arranged at positions corresponding to each pressure chamber; and a plurality of piezoelectric sheets which are sequentially laminated, the piezoelectric sheet most distant from the pressure chamber being sandwiched between the common electrode and at least one of the individual electrodes, and each of the individual electrodes arranged on a face of the piezoelectric sheet most distant from the pressure chamber facing the direction opposite to the pressure chamber being electrically bonded to the electricity feeding member at each of a plurality of electric contacts on the individual electrode; and wherein the individual electrode comprises:

a first electrode region having a planar shape similar to a planar shape of the pressure chamber;

a second electrode region connected to one end of the first electrode region and having one of the electric contacts; and a third electrode region connected to the other end of the first electrode region opposing to the second electrode region and having one of the electric contacts;

wherein the interconnecting part of the first electrode region and the second electrode region is provided with a length shorter than lengths of the first electrode region and the second electrode region with respect to a direction substantially orthogonal to a direction of connecting the second electrode region and the third electrode region; and wherein the interconnecting part of the first electrode region and the third electrode region is provided with a length shorter than lengths of the first electrode region and the third electrode region with respect to the direction substantially orthogonal to the direction of connecting the second electrode region and the third electrode region.

15. The ink-jet head according to claim 14, wherein the electricity feeding member includes a plurality of feeding terminals and wherein each of the individual electrodes, which is arranged on a face of the piezoelectric sheet most distant from the pressure chamber and faces the direction opposite to the pressure chamber, includes a plurality of electric contacts, each one of the plurality of electric contacts being electrically bonded to a corresponding one of the plurality of feeding terminals.

16. An ink-jet printer including an ink-jet head comprising:

a passage unit including a plurality of pressure chambers each having one end connected with a nozzle and the other end to be connected with an ink supply source, the plurality of pressure chambers being arranged along a plane and neighboring each other;

an actuator unit fixed to a surface of the passage unit for chanting the volume of each of the pressure chambers; and an electricity feeding member for supplying a drive signal to the actuator unit;

wherein the actuator unit comprises:

a common electrode maintained at a constant potential;

a plurality of individual electrodes arranged at positions corresponding to each pressure chamber; and a plurality of piezoelectric sheets which are sequentially laminated, the piezoelectric sheet most distant from the pressure chamber being sandwiched between the common electrode and at least one of the individual electrodes, and each of the individual electrodes arranged on a face of the piezoelectric sheet most distant from the pressure chamber facing the direction opposite to the pressure chamber being electrically bonded to the electricity feeding member at each of a plurality of electric contacts on the individual electrode.

17. The ink-jet head according to claim 16, wherein the electricity feeding member includes a plurality of feeding terminals and wherein each of the individual electrodes, which is arranged on a face of the piezoelectric sheet most distant from the pressure chamber and faces the direction opposite to the pressure chamber, includes a plurality of electric contacts, each one of the plurality of electric contacts being electrically bonded to a corresponding one of the plurality of feeding terminals.

18. An ink-jet printer including an ink-jet head comprising:

a passage unit including a plurality of pressure chambers each having one end connected with a nozzle and the other end to be connected with an ink supply source, the plurality of pressure chambers being arranged along a plane and neighboring each other;

an actuator unit fixed to a surface of the passage unit for changing the volume of each of the pressure chambers; and an electricity feeding member having a feeding terminal for supplying a drive signal to the actuator unit;

wherein the actuator unit comprises:

a common electrode maintained at a constant potential;

a plurality of individual electrodes arranged at positions corresponding to each pressure chamber;

a plurality of piezoelectric sheets which are sequentially laminated, the piezoelectric sheet most distant from the pressure chamber being sandwiched between the common electrode and at least one of the individual electrodes, and the each of the individual electrodes arranged on a face of the piezoelectric sheet most distant from the pressure chamber facing the direction opposite to the pressure chamber being electrically bonded to the feeding terminal; and a plurality of peripheral electrodes arranged on the face of the piezoelectric sheet most distant from the pressure chamber facing the direction opposite to the pressure chamber at the periphery of a region in which the plurality of the individual electrodes are arranged, at least one of the peripheral electrodes being electrically connected to the common electrode and electrically bonded to the feeding terminal.

* * * * *